US007995951B2

(12) United States Patent
Nieda

(10) Patent No.: US 7,995,951 B2
(45) Date of Patent: Aug. 9, 2011

(54) IMAGE FORMING APPARATUS AND DRIVE-SWITCHING METHOD

(75) Inventor: Hiroaki Nieda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 352 days.

(21) Appl. No.: 12/034,332

(22) Filed: Feb. 20, 2008

(65) Prior Publication Data

US 2009/0047040 A1 Feb. 19, 2009

(30) Foreign Application Priority Data

Aug. 17, 2007 (JP) ..... 2007-212851

(51) Int. Cl.
*G03G 15/00* (2006.01)
*G03G 21/16* (2006.01)

(52) U.S. Cl. ..... 399/167; 399/110; 399/111; 399/299

(58) Field of Classification Search ..... 399/110, 399/111, 167, 299
See application file for complete search history.

(56) References Cited

U.S. PATENT DOCUMENTS

| | | | | |
|---|---|---|---|---|
| 6,453,135 | B1 * | 9/2002 | Sameshima et al. | 399/110 |
| 6,795,671 | B2 * | 9/2004 | Matsuoka | 399/223 |
| 7,031,642 | B2 * | 4/2006 | Abe | 399/167 |
| 7,274,885 | B2 | 9/2007 | Yokogawa | |
| 2003/0086732 | A1 * | 5/2003 | Abe et al. | 399/299 |
| 2005/0214023 | A1 * | 9/2005 | Foster et al. | 399/110 |
| 2007/0077090 | A1 * | 4/2007 | Kim et al. | 399/167 |
| 2007/0116497 | A1 | 5/2007 | Yamazaki | |
| 2007/0177899 | A1 * | 8/2007 | Kawamura | 399/223 |

FOREIGN PATENT DOCUMENTS

| | | |
|---|---|---|
| CN | 1752869 A | 3/2006 |
| JP | A-07-181773 | 7/1995 |
| JP | A-2006-251572 | 9/2006 |

OTHER PUBLICATIONS

Chinese Office Action issued on Apr. 30, 2010 in corresponding Chinese Patent Application No. 200810094516.1.
Japanese Patent Office, English translation of Notification of Reasons for Refusal of Japanese Patent Application No. 2007-2128512, Apr. 12, 2001, pp. 1-2.

* cited by examiner

*Primary Examiner* — David M Gray
*Assistant Examiner* — Francis Gray
(74) *Attorney, Agent, or Firm* — Oliff & Berridge, PLC

(57) ABSTRACT

The image forming apparatus is provided with: plural rotating members that are arranged rotatably; plural rotation side coupling members that are provided corresponding to the respective rotating members and transmit drive force to the respective rotating members; plural drive side coupling members that are connected to the respective rotation side coupling members and rotate and drive the respective rotating members via the rotation side coupling members; and an interconnecting unit that connects a predetermined number of the drive side coupling members among the plural drive side coupling members to the corresponding rotation side coupling members.

3 Claims, 23 Drawing Sheets

IMAGE FORMING APPARATUS AND DRIVE-SWITCHING METHOD

CROSS REFERENCE TO RELATED APPLICATIONS

This application is based on and claims priority under 35 USC §119 from Japanese Patent Application No. 2007-212851 filed Aug. 17, 2007.

BACKGROUND

1. Technical Field

The present invention relates to an image forming apparatus such as a printer and a copy machine, and a drive-switching method.

2. Related Art

In an image forming apparatus of so-called tandem system having photoconductor drums for respective colors, image formation in full colors is not always required, but image formation in a single color (for example, black) is required in some cases. In such cases, if photoconductor drums that are not used in the image formation are rotated, abrasion and the like of the photoconductor drums are facilitated by a cleaning blade and the like.

SUMMARY

According to an aspect of the invention, there is provided an image forming apparatus including: plural rotating members that are arranged rotatably; plural rotation side coupling members that are provided corresponding to the respective rotating members and transmit drive force to the respective rotating members; plural drive side coupling members that are connected to the respective rotation side coupling members and rotate and drive the respective rotating members via the rotation side coupling members; and an interconnecting unit that connects a predetermined number of the drive side coupling members among the plural drive side coupling members to the corresponding rotation side coupling members.

BRIEF DESCRIPTION OF THE DRAWINGS

Exemplary embodiment(s) of the present invention will be described in detail based on the following figures, wherein:

FIG. 13 is a side view that shows the side portion of the switching unit, including the cover and the like;

DETAILED DESCRIPTION

Hereinafter, the first exemplary embodiment of the present invention will be described in detail with reference to the accompanying drawings.

Figure 1:
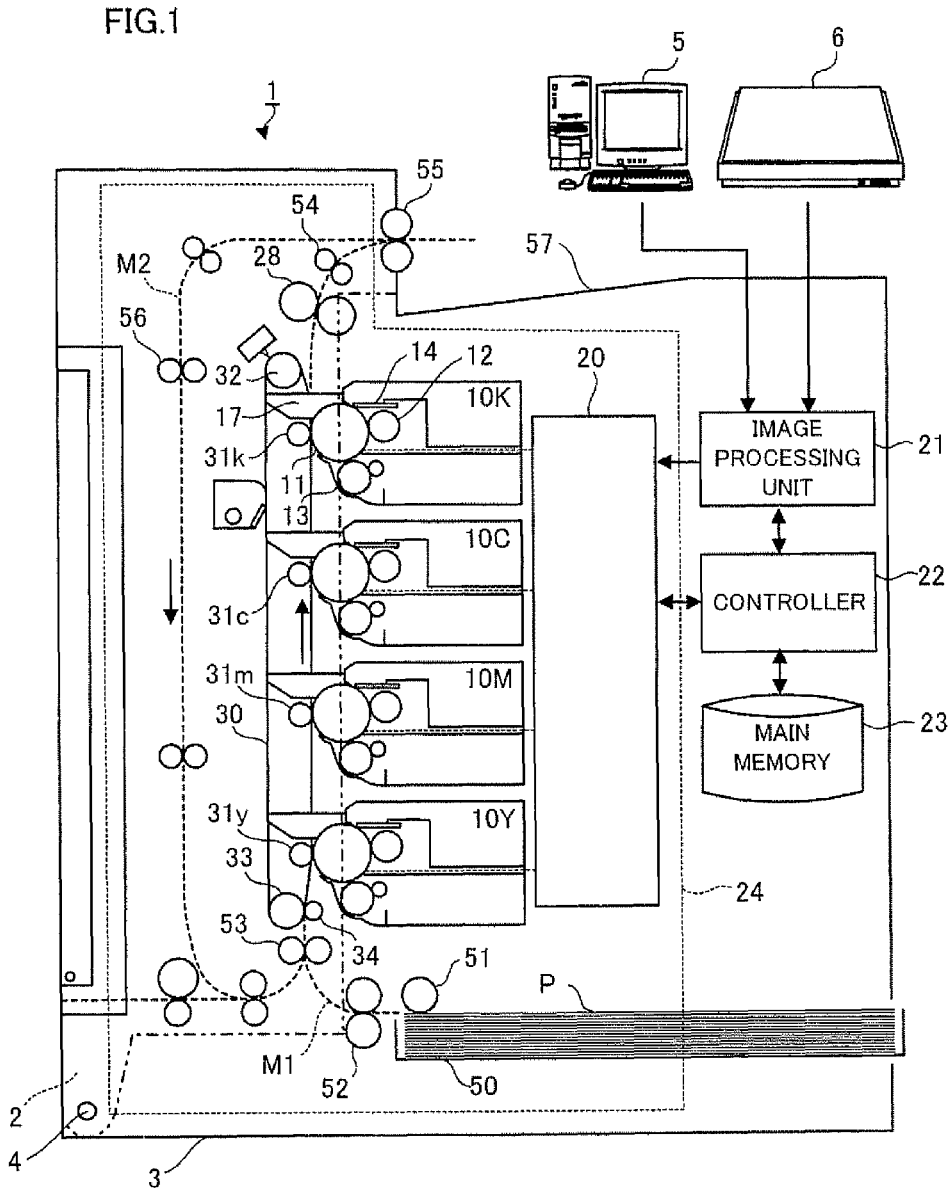
FIG. 1 is a view that shows an entire configuration of an image forming apparatus to which the first exemplary embodiment is applied.

FIG. 1 is a view that shows an entire configuration of an image forming apparatus 1 to which the first exemplary embodiment is applied. The image forming apparatus 1 shown in FIG. 1 is what is termed as a tandem-type digital color printer with electrophotography, and includes an image forming process unit 24 that forms an image in response to image data of each color, inside of a cover 2 and an apparatus main body 3. Further, the image forming apparatus 1 includes a controller 22 that controls operations of respective portions and apparatuses provided in the image forming apparatus 1. Furthermore, the image forming apparatus 1 includes a image processing unit 21 that performs certain image processing on image data received from, for example, a personal computer (PC) 5, an image reading apparatus 6 such as a scanner and the like, and a main memory 23 that is realized by, for example, a hard disk (hard disk drive) on which processing programs, image data and the like are recorded.

In the image forming process unit 24, four image forming units 10Y, 10M, 10C and 10K (hereinafter, collectively referred to as the "image forming unit 10") are arranged in parallel at a fixed interval in the up and down direction. The image forming unit 10 is provided with a photoconductor drum 11 serving as a rotating member and an image carrier, an electrically charging roll 12 that electrically charges a surface of the photoconductor drum 11, a developing unit 13 that develops an electrostatic latent image formed on the photoconductor drum 11 by each color toner, and a drum cleaner 14 that cleans the surface of the photoconductor drum 11 after transfer.

The image forming unit 10 is arranged to be exchangeable (detachable) from the apparatus main body 3. For example, in the case where the toner within the developing unit 13 is consumed, the photoconductor drum 11 comes to the end of the life or the like, each of the image forming units 10 is exchanged. It should be noted that, in order to make the exchange easier and the like, the image forming unit 10 is equipped with a grasp portion 17that is grasped by a user.

The electrically charging roll 12 is formed by a roll member in which a conductive elastic-body layer and a conductive surface layer are laminated on a conductive core such as aluminum and stainless steel. The electrically charging roll 12 receives an electrically charging bias voltage from an electrically charging power source (not shown in the figure), and while rotating driven by the photoconductor drum 11, electrically charges the surface of the photoconductor drum 11 uniformly at a fixed potential.

In each image forming unit 10, the developing unit 13 holds a two-component developer including each color toner of yellow (Y), magenta (M), cyan (C) and black (K) and a magnetic carrier, and develops the electrostatic latent image formed on the photoconductor drum 11 by each color toner.

The drum cleaner 14 brings a plate member that is formed by a rubber material such as urethane rubber into contact with the surface of the photoconductor drum 11, and removes the toner, paper dust and the like that are adhered on the photoconductor drum 11.

Moreover, in the image forming apparatus 1 according to the first exemplary embodiment, a laser exposing unit 20 that exposes the photoconductor drum 11 arranged respectively in each image forming unit 10 is provided. The laser exposing unit 20 acquires image data for each color from an image processing unit 21. By laser beam that is controlled for lighting on the basis of the acquired image data, the laser exposing unit 20 scans and exposes the surface of the photoconductor drum 11 of each image forming unit 10, respectively.

Further, so as to move while being in contact with the photoconductor drum 11 of each image forming unit 10, a paper transportation belt 30 that transports paper P serving as a recording medium (recording paper) is arranged in the image forming apparatus 1 of the first exemplary embodiment. The paper transportation belt 30 is formed by an endless belt in a film shape that electrostatically absorbs the paper P. The paper transportation belt 30 is hanged between an idle roll 32 and a drive roll 33 and cyclically moved. Between the paper transportation belt 30 and the photoconductor drum 11, a paper transportation route M1 is formed for transporting the paper P from the lower side to the upper side in the substantially vertical direction.

In positions inside the paper transportation belt 30 and opposed to each photoconductor drum 11, transfer rolls 31*y*, 31*m*, 31*c* and 31*k* (hereinafter, collectively referred to as the "transfer roll 31") are arranged. Each transfer roll 31 forms a transfer electric field between the transfer roll 31 and the photoconductor drum 11 so as to successively transfer a toner image of each color that is formed in each image forming unit 10 on the paper P that is held and transported by the paper transportation belt 30. Moreover, on the outside of the paper transportation belt 30, and on the downstream side of each transfer roll 31, a discharge lamp (not shown in the figure) that removes electricity of the photoconductor drum 11 after the transfer is provided.

In the most upstream portion on the side where the photoconductor drum 11 of the paper transportation belt 30 is located, an absorption roll 34 that electrically charges the paper transportation belt 30 is arranged. The absorption roll 34 electrically charges a surface of the paper transportation belt 30 at a predetermined potential so that the paper P is stably electrostatically absorbed.

On the downstream side of the paper transportation belt 30 on the paper transportation route M1, a fixing unit 28 that performs a fixing treatment to a non-fixed toner image on the paper P with heat and pressure is provided.

Further, as a paper transportation system other than the paper transportation belt 30, on the paper supplying side, a paper housing unit 50 that houses the paper P, a pickup roll 51 that takes out the paper P housed in the paper housing unit 50 at a predetermined timing and transports the paper P, a transportation roll 52 that transports the paper P brought by the pickup roll 51, and a resist roll 53 that feeds the paper P to the paper transportation belt 30 corresponding to an image forming operation are provided.

Meanwhile, on the paper exit side, a paper exit roll 54 that transports the paper P fixed in the fixing unit 28 is provided. Additionally, on the paper exit side, a reverse roll 55 is provided The reverse roll 55, in the case of single side printing, discharges the paper P to a paper exit unit 57 provided on an upper portion of the apparatus main body 3, whereas the reverse roll 55, in the case of both-side printing, rotates in the reverse direction so as to feed the paper P whose one side surface is fixed in the fixing unit 28 to a both-side transportation route M2. In addition, in the both-side transportation route M2, plural transporting rolls 56 are provided along the both-side transportation route M2.

In the image forming apparatus 1 according to the first exemplary embodiment, the image forming process unit 24 performs the image forming operation under control by a controller 22. Specifically, the image processing unit 21 performs a predetermined image processing to the image data inputted from PC 5, an image reading apparatus 6 or the like, and the image data is supplied to the laser exposing unit 20. Then, for example, in the image forming unit 10K of black (K), the surface of the photoconductor drum 11 that is uniformly electrically charged by the electrically charging roll 12 at a predetermined potential is scanned and exposed with the laser beam that is controlled for lighting by the laser exposing unit 20 on the basis of the image data from the image processing unit 21, and the electrostatic latent image is formed on the photoconductor drum 11. The formed electrostatic latent image is developed by the developing unit 13, and on the photoconductor drum 11, a toner image of black (K) is formed. In the image forming units 10Y, 10M and 10C, in a similar manner, toner images of each color of yellow (Y), magenta (M) and cyan (C) are formed.

Meanwhile, when formation of the toner image of each color in each image forming unit 10 is started, the paper P that is taken out from the paper housing unit 50 is supplied to the paper transportation belt 30 by the resist roll 53 corresponding to a formation timing of the toner image. The surface of the paper transportation belt 30 is electrically charged by the absorption roll 34 at a predetermined potential. Thereby, the paper P is electrostatically absorbed on the paper transportation belt 30. By the paper transportation belt 30 that is cyclically moved in the arrow direction of FIG. 1, the paper P is transported along the paper transportation route M1. In the middle course of the transportation, by the transfer electric field that is formed by the transfer roll 31, the toner image of each color is successively transferred on the paper P.

The paper P where the toner image of each color is electrostatically transferred is detached from the paper transportation belt 30 on the downstream of the image forming unit 10K, and transported to the fixing unit 28. When the paper P is transported to the fixing unit 28, the non-fixed toner image on the paper P is fixed to the paper P by receiving the fixing treatment with heat and pressure. The paper P where the toner image of each color is fixed is loaded in the paper exit unit 57 that is provided in an exit portion of the image forming apparatus 1. Meanwhile, at the time of both-side printing, after a similar image forming operation is performed again via the both-side transportation route M2, the paper P is loaded in the paper exit unit 57.

Further, the image forming apparatus 1 is explained.

Figure 2:
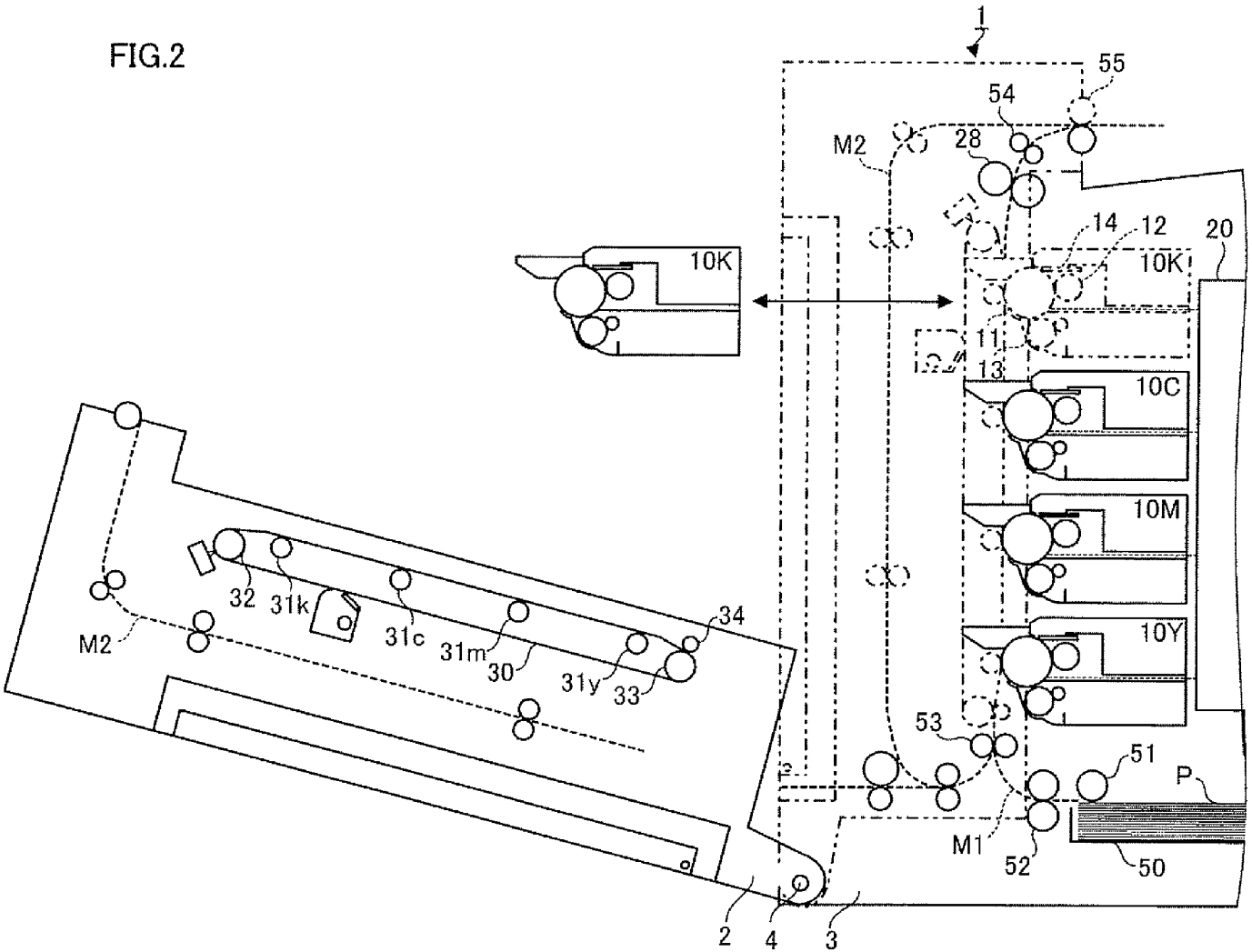
FIG. 2 is a view that shows the image forming apparatus with the cover opened.

FIG. 2 is a view that shows the image forming apparatus 1 with the cover 2 opened.

As mentioned above, the image forming apparatus 1 according to the first exemplary embodiment is provided with the cover 2 and the apparatus main body 3. This cover 2 is arranged so as to be openable and closable to the apparatus main body 3 around a fulcrum 4 which is provided on the lower side. Further, to the cover 2, the paper transportation belt 30, the transfer roll 31, the idle roll 32, the drive roll 33, and the absorption roll 34 and the like are attached. Therefore, when the cover 2 is opened, as shown in the figure, the paper transportation belt 30, the transfer roll 31, and the idle roll 32 and the like follow the cover 2. As a result, when the cover 2 is opened, the image forming unit 10 is in an exposed state, and the user and the like may access the paper transportation route M1. Here, the image forming unit 10, as mentioned above, is arranged to the apparatus main body 3 so as to be exchangeable, and when toner in the developing unit 13 is consumed, the image forming unit 10 is exchanged as a unit. In addition, the image forming apparatus 1 in the first exemplary embodiment is provided with a sensor (not shown in the figure) that performs a predetermined output when the cover 2 is closed.

Figure 3A:
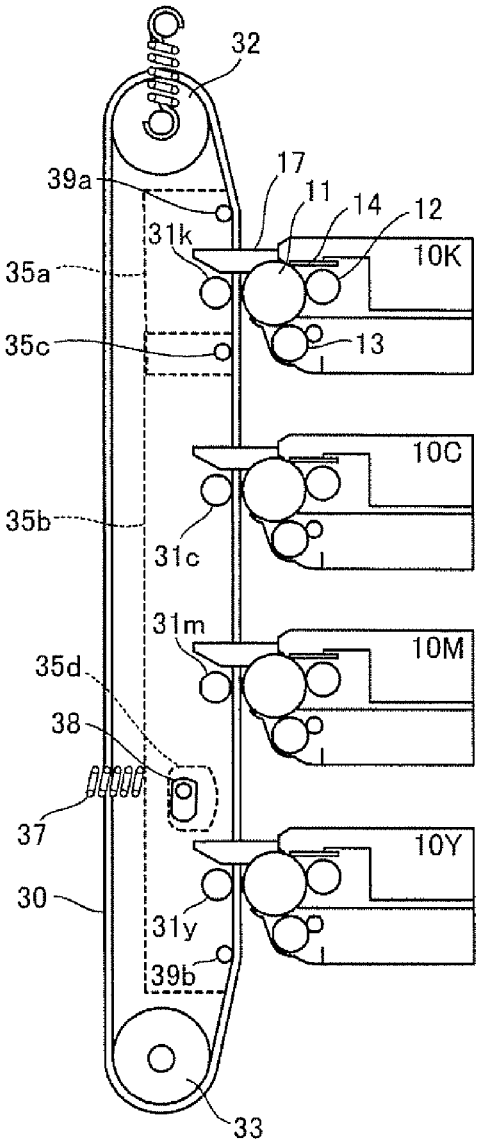
FIGS. 3A and 3E are explanatory views each showing details around the paper transportation belt.
Figure 3B:
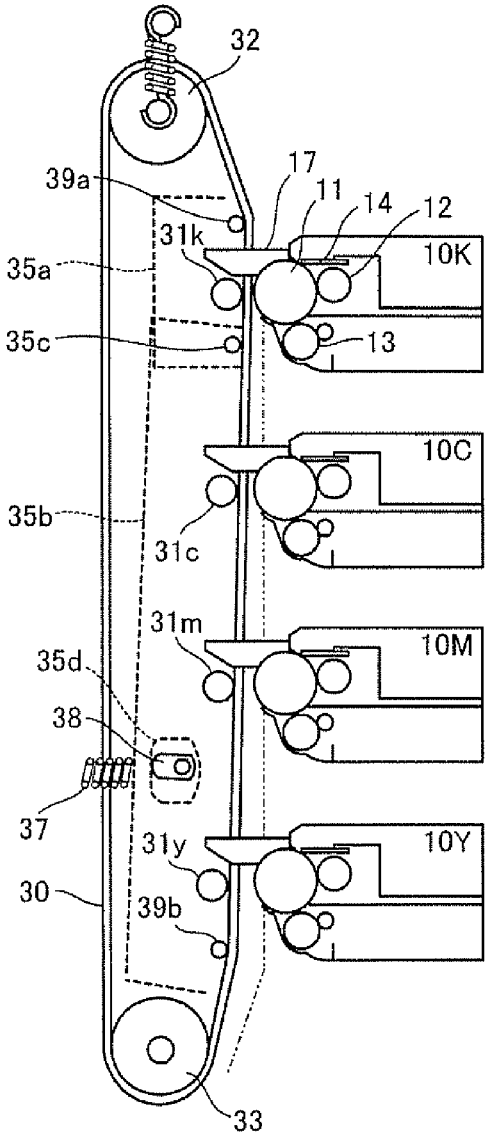

Here, FIGS. 3A and 3B are explanatory views each showing details around the paper transportation belt 30. In the image forming apparatus 1 according to the first exemplary embodiment, when an image formation is carried out by use of the image formation units 10Y, 10M, 10C and 10K of yellow (Y), magenta (M), cyan (C) and black (K), that is, when an image formation in full colors is carried out, the paper transportation belt 30 is arranged so as to be brought in contact with all the photoconductor drums 11. Further, when an image formation is carried out by use of the image forming unit 10K of black (K), that is, an image is formed in a single color, the paper transportation belt 30 is arranged so as to be separated from the photoconductor drums 11 in the image forming units 10Y, 10M and 10C.

In more particular, as shown in FIG. 3A, the image forming apparatus 1 according to the first exemplary embodiment (refer to FIG. 1) is provided with a first supporting part 35*a* that rotatably supports the transfer roll 31*k*, and a second supporting part 35*b* that rotatable supports the transfer rolls 31*y*, 31*m* and 31*c*, at the inner circumferential side of the paper transportation belt 30. Further, the image forming apparatus 1 is provided with a cam 38 that is arranged rotatably and functions as a separating unit, and a drive source (not shown in the figure) that rotates and drives the cam 38. Furthermore, the image forming apparatus 1 is provided with a coil spring 37 that pushes the second supporting part 35*b* to the image forming unit 10 side.

The first supporting part 35*a*, as mentioned above, is provided with a regulating roll 39*a* that rotatably supports the transfer roll 31*k*, and regulates the moving direction of the paper transportation belt 30 that passes the transfer roll 31*k*.

The second supporting part 35*b* is arranged on the opposite side of the image forming units 10Y, 10M and 10C across the paper transportation belt 30. Further, the second supporting part 35*b* is provided with an opening hole 35*d* into which the cam 38 is arranged, between the transfer roll 31*y* and the transfer roll 31*m*. Furthermore, the second supporting part 35*b* is provided with a regulating roll 39*b* that regulates the moving direction of the paper transportation belt 30 that passes the drive roll 33, on the upstream side of the transfer roll 31*y* in the moving direction of the paper transportation belt 30.

Meanwhile, between the first supporting part 35*a* and the second supporting part 35*b*, a fulcrum 35*c* for rotating (swinging) the second supporting part 35*b* to the first supporting part 35*a* is provided.

In the first exemplary embodiment, when an image formation in a single color is carried out by use of the image forming unit 10K, the cam 38 is rotated clockwise in the figure by use of a drive source (not shown in the figure), and the second supporting part 35*b* is rotated clockwise in the figure against the pushing force by the coil spring 37. As a result, as shown in FIG. 3B, the paper transportation belt 30 is separated from the photoconductor drums 11 in the image forming units 10Y, 10M and 10C. Then, when the paper transportation belt 30 is separated from the photoconductor drums 11 in the image forming units 10Y, 10M and 10C, the rotation of the photoconductor drums 11 (photoconductor drums 11 in the image forming units 10Y, 10M and 10C) is stopped by the movement of the paper transportation belt 30. Meanwhile, when the paper transportation belt 30 is to be made to be brought in contact with the photoconductor drums 11 once again, the cam 38 is rotated counterclockwise in the figure, and the second supporting part 35*b* is rotated counterclockwise in the figure by the coil spring 37.

Here, the photoconductor drums 11 in the image forming unit 10 are rotated by the drive unit and the like which are provided in the apparatus main body 3 (refer to FIG. 1).

Figure 4:
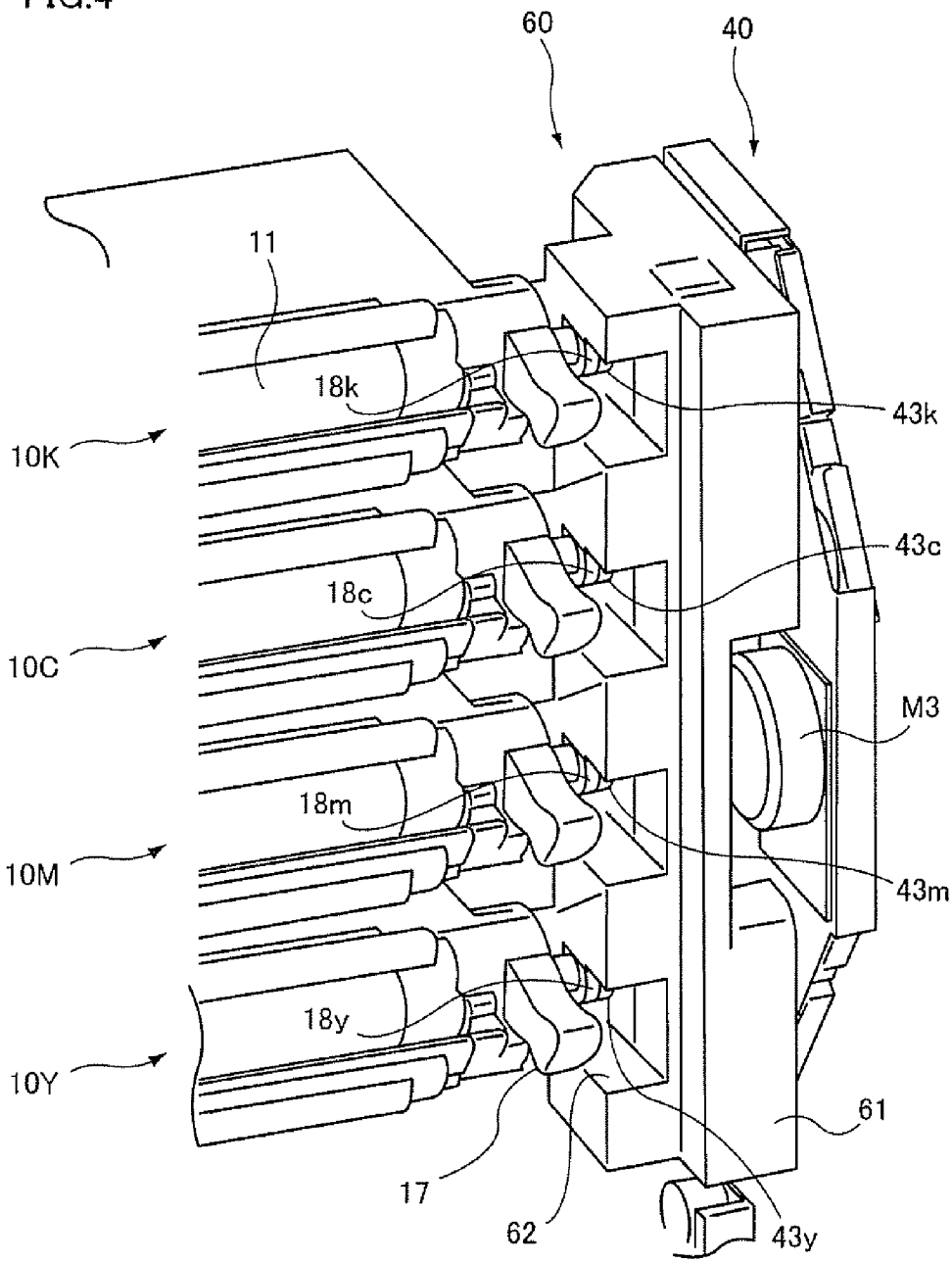
FIG. 4 is a perspective view that shows one side of the image forming unit.

FIG. 4 is a perspective view that shows one side of the image forming unit 10. As shown in the figure, in the first exemplary embodiment, to the one side of the image forming unit 10, a drive unit 40 that rotates and drives the respective photoconductor drums 11 in the image forming unit 10 is arranged. Further, a switching unit 60 that transmits or does not transmit the drive force from the drive unit 40 to the photoconductor drums 11 is arranged.

Each of the image forming units 10 in the first exemplary embodiment is provided with, on the side thereof, photoconductor side coupling members 18*y*, 18*m*, 18*c* and 18*k* (hereinafter referred to also as "photoconductor side coupling members 18") that are attached to the photoconductor drums 11, rotate interlocking with the photoconductor drums 11, and serve as an example of rotation side coupling members, a Y-color coupling member, a M-color coupling member, a C-color coupling member and a K-color coupling member.

On the other hand, the drive unit 40 is provided with a motor M3 and drive side coupling members 43*y*, 43*m*, 43*c* and 43*k* that are arranged in correspondence with the respective photoconductor side coupling members 18 and are rotated and driven by the drive force generated by the motor M3 (hereinafter, referred to also as "drive side coupling members 43") Each of the drive side coupling members 43 that also functions as an example of a Y-color drive coupling member, a M-color drive coupling member, C-color drive coupling member and K-color drive coupling member is in an exposed state in four slots 62 formed in a housing 61 of the switching unit 60. Further, the respective drive side coupling members 43 are interconnected with corresponding photoconductor side coupling members 18. As a result, the respective photoconductor drums 11 are rotated and driven by the drive force from the motor M3.

Figure 5:
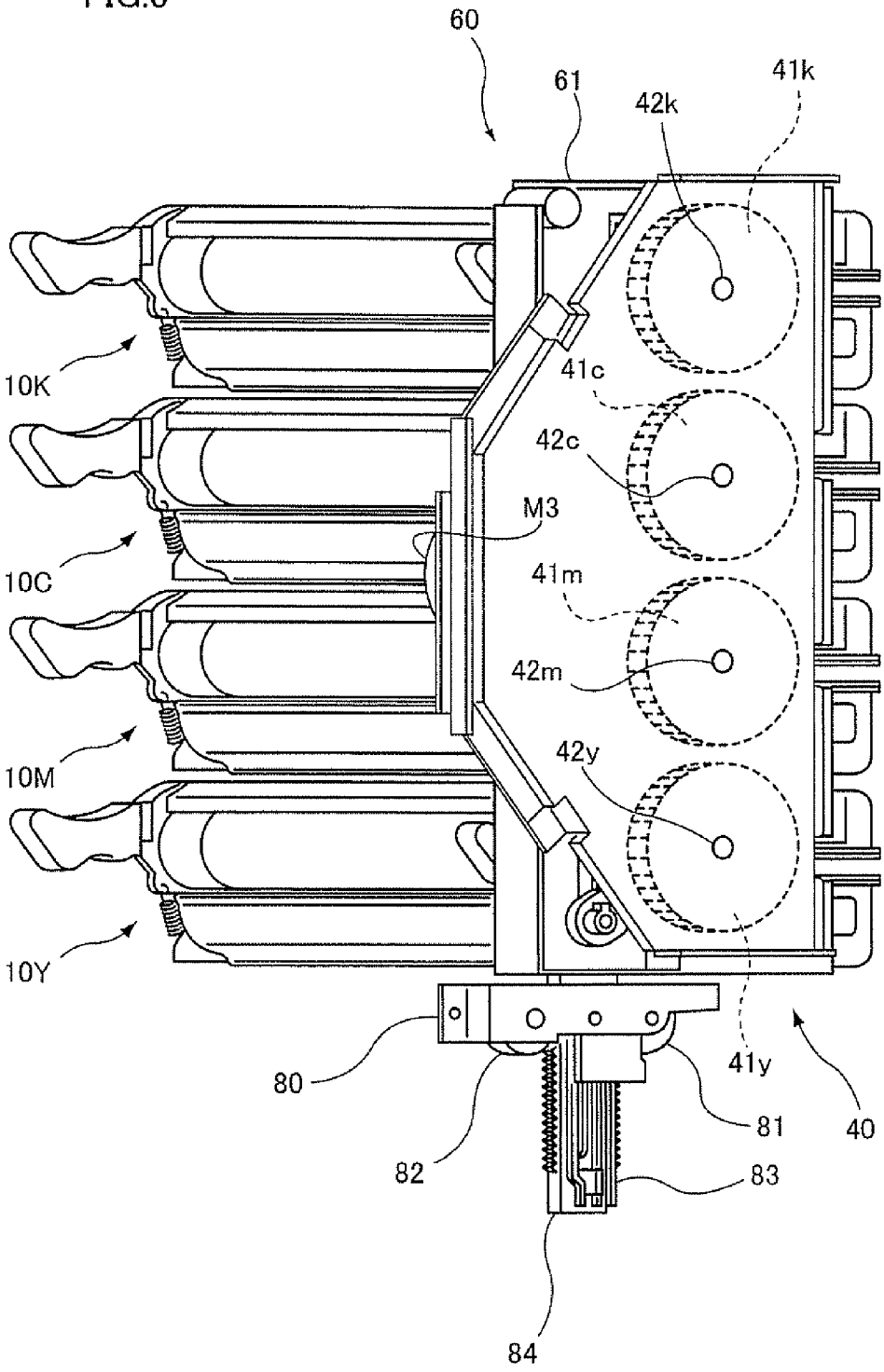
FIG. 5 is a perspective view that shows the image forming units and the like viewed from the drive unit side.

FIG. 5 is a perspective view that shows the image forming units 10 and the like viewed from the drive unit 40 side.

As shown in the figure, the drive unit 40 in the first exemplary embodiment is provided with four shafts 42*y*, 42*m*, 42*c* and 42*k* that are arranged adjacently in the vertical direction, and rotatably arranged. Further, the drive unit 40 is provided with four gears 41*y*, 41*m*, 41*c* and 41*k* (hereinafter, referred to also as "gears 41") that are attached to the shafts 42*y*, 42*m*, 42*c* and 42*k* respectively. These gears 41 are arranged in a state where the gears 41 are engaged with transmission gears (not shown in the figure) that transmit the drive force from the motor M3, and are rotated and driven by the drive force from the motor M3. Thereby, the shafts 42*y*, 42*m*, 42*c* and 42*k* are rotated and driven.

On the other hand, the switching unit 60 that functions as an example of an interconnecting unit is provided with a first drive gear 81 as an example of drive member that rotates and drives, and a second drive gear 82 that rotates and drives. Further, the switching unit 60 is provided with a first movable plate 83 that is arranged along the side surface of the housing 61, receives the drive force from the first drive gear 81 and the like, and slides in the vertical direction. The first movable plate 83 in the first exemplary embodiment functions as an example of a first interconnecting mechanism.

Furthermore, the switching unit 60 is provided with a second movable plate 84 that is arranged along the side surface of the housing 61, receives the drive force from the second drive gear 82 and the like, and slides in the vertical direction. The second movable plate 84 in the first exemplary embodiment functions as one of second interconnecting mechanisms. Further, the switching unit 60 is provided with a holding member 80 that is attached to the apparatus main body 3 side (refer to FIG. 1), and holds the first drive gear 81 and the second drive gear 82 rotatably.

Here, the switching unit 60 is explained further in detail.

Figure 6:
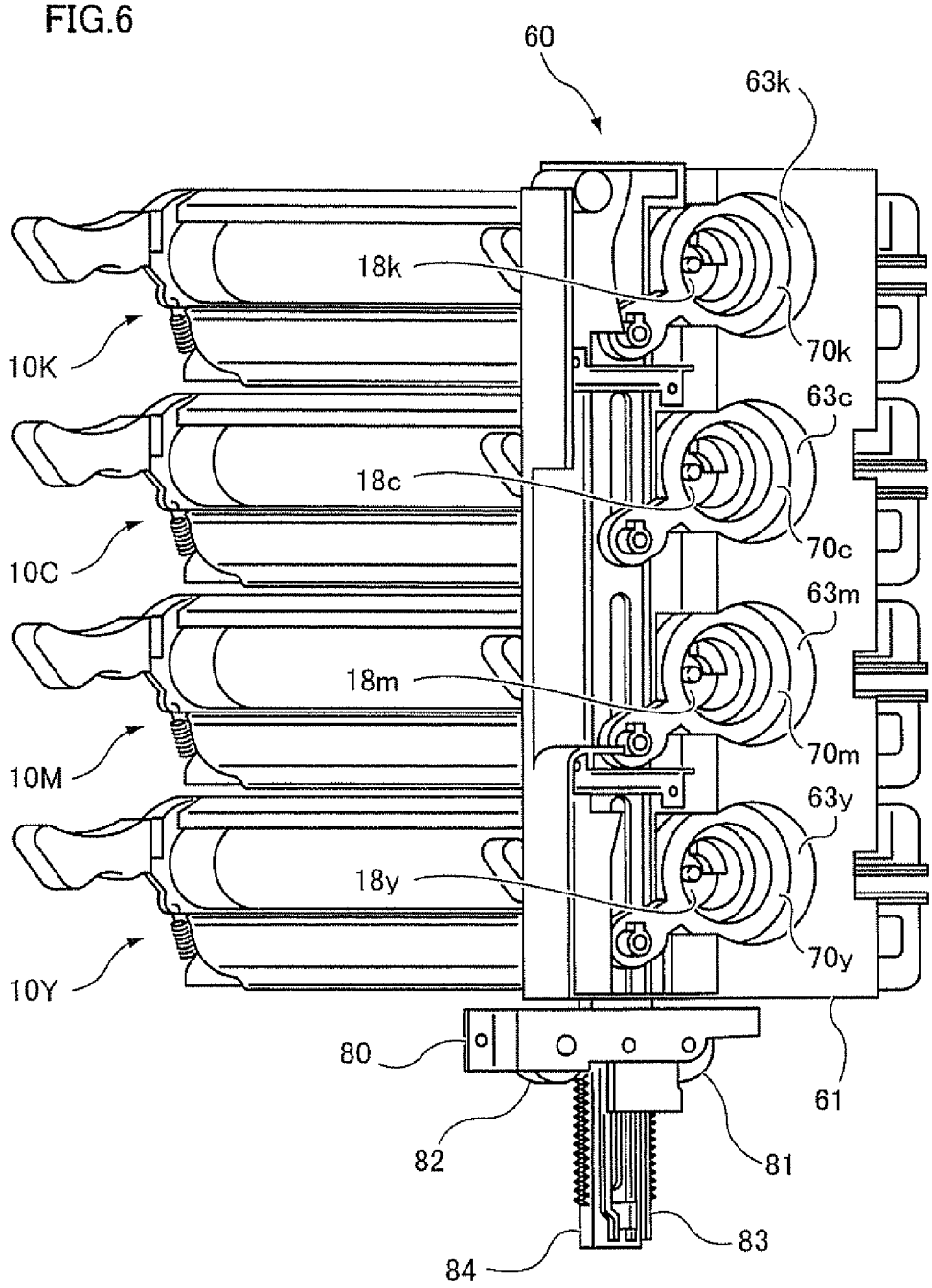
FIG. 6 is a perspective view that shows the switching unit and the like viewed from the drive unit side.

FIG. 6 is a perspective view that shows the switching unit 60 and the like viewed from the drive unit 40 side. Note that in this figure, the illustration of the drive unit 40 (refer to FIG. 5) is omitted.

Although details are described later herein, the switching unit 60 is provided with four advancing/retreating members 70*y*, 70*m*, 70*c* and 70*k* (hereinafter, referred to also as "advancing/retreating members 70") that advance to and retreat from the photoconductor side coupling members 18, interlocking with the first movable plate 83 and the second movable plate 84. Further the respective advancing/retreating members 70 are rotatably stored in four storing portions 63*y*, 63*m*, 63*c* and 63*k* (hereinafter, referred to also as "storing portions 63") that are arranged in parallel in the vertical direction on the side portion of the housing 61. Furthermore, the switching unit 60 is provided with, at the side portion thereof, a guide (not shown in the figure) that regulates the slide direction of the first movable plate 83 and the second movable plate 84. In the first exemplary embodiment, the advancing/retreating members 70*y*, 70*m* and 70*c* function as an example of the first interconnecting mechanism, and the advancing/retreating member 70*k* functions as an example of a second interconnecting mechanism.

Further, the advancing/retreating members 70 and the like are explained in detail.

Figure 7:
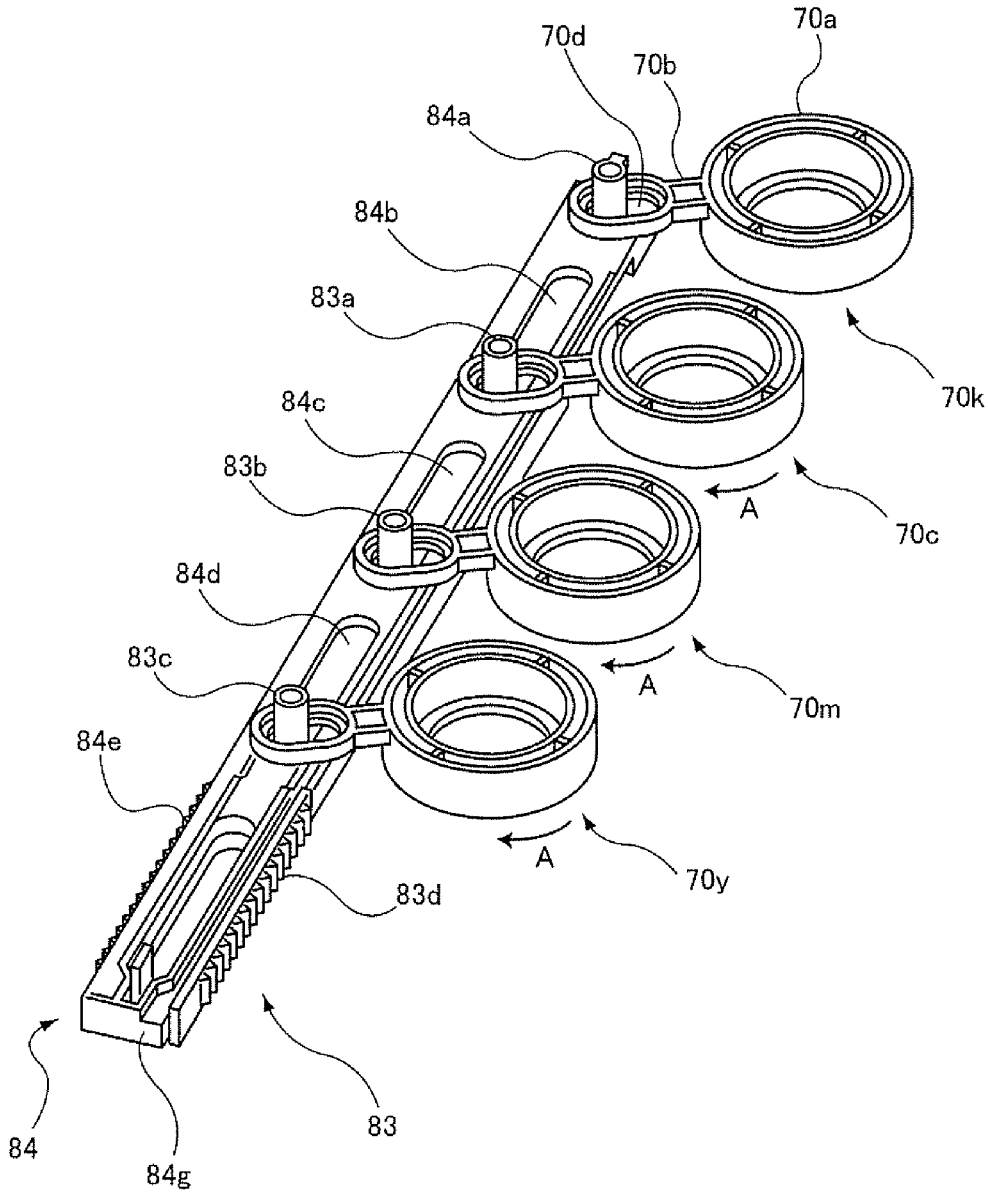
FIG. 7 is a perspective view that shows the first movable plate, the second movable plate, and the advancing/retreating members.

Herein, FIG. 7 is a perspective view that shows the first movable plate 83, the second movable plate 84, and the advancing/retreating members 70.

As shown in the figure, each of the advancing/retreating members 70 is provided with a ring portion 70*a* that has an opening hole at the center and is formed into a ring shape, an arm portion 70*b* that protrudes outward from the ring portion 70*a*, and a opening hole 70*d* that is formed into a long hole shape at the end portion of the arm portion 70*b*.

On the other hand, the second movable plate 84 is formed into a long and thin plate shape, and is provided with a protruding portion 84*a* that protrudes to the drive unit 40 side and is arranged through the opening hole 70*d* of the advancing/retreating member 70*k*, at the drive unit 40 (refer to FIG. 5) and at the upper end. Further, the second movable plate 84 is provided with a rack gear portion 84*e* that engages with the second drive gear 82 (refer to FIG. 6), at one side surface and at the lower end portion.

Furthermore, the second movable plate 84 is provided with an upper long hole 84*b* that is made so as to penetrate the second movable plate 84 and formed along the slide direction of the first movable plate 83, at the lower portion of the protruding portion 84*a*. Moreover, the second movable plate 84 is provided with a middle long hole 84*c* that is made so as to penetrate the second movable plate 84 and formed along the slide direction of the first movable plate 83, at the lower portion of the protruding portion 84*b*. Further, the second movable plate 84 is provided with a lower long hole 84*d* that is made so as to penetrate the second movable plate 84 and formed along the slide direction of the first movable plate 83, at the lower portion of the middle long hole 84*c*, and at the upper portion of the rack gear portion 84*e*. Furthermore, the second movable plate 84 is provided with a stopping portion 84*g* that the lower end portion of the first movable plate 83 reaches, at the lower end portion.

The first movable plate 83 is formed into a long and thin plate shape, in the same manner as the second movable plate 84. Further, the first movable plate 83 is arranged closer to the housing 61 (refer to FIG. 6) than the second movable plate 84, and arranged to be lapped over the second movable plate 84. Furthermore, the first movable plate 83 is arranged so as to slide in the slide direction of the second movable plate 84.

Furthermore, the first movable plate 83 is provided with a first protruding portion 83*a* that is arranged through the upper long hole 84*b* and the opening hole 70*d* in the advancing/retreating member 70*c*, on the surface opposed to the second movable plate 84 and at the upper end portion. Moreover, the first movable plate 83 is provided with a second protruding portion 83*b* that is arranged through the middle long hole 84*c* and the opening hole 70*d* in the advancing/retreating member 70*m*, at the position lower than the first protruding portion 83*a*. Further, the first movable plate 83 is provided with a third protruding portion 83*c* that is arranged through the upper long hole 84*d* and the opening hole 70*d* in the advancing/retreating member 70*y* at the lower position of the second protruding portion 83*b*. Furthermore, the first movable plate 83 is provided with a rack gear portion 83*d* that engages with the first drive gear 81 (refer to FIG. 6), at the side surface opposite to the side where the rack gear portion 84*e* is arranged, and at the lower end portion.

The figure shows a state where the first movable plate 83 is located at the lower position, and the lower end portion of the first movable plate 83 stops at the stopping portion 84*g* in the second movable plate 84 (hereinafter, this state is referred to as "first state"). In the first state, the first protruding portion 83*a* is located at the lower portion of the upper long hole 84*b*, and the second protruding portion 83*b* is located at the lower portion of the middle long hole 84*c*, and the third protruding portion 83*c* is located at the lower portion of the lower long hole 84*d*. Since the first protruding portion 83*a*, the second protruding portion 83*b* and the third protruding portion 83*c* are located as above, and as a result, the arm portions 70*b* in the advancing/retreating members 70*c*, 70*m* and 70*y* are directed diagonally downward (refer also to FIG. 6).

Figure 8:
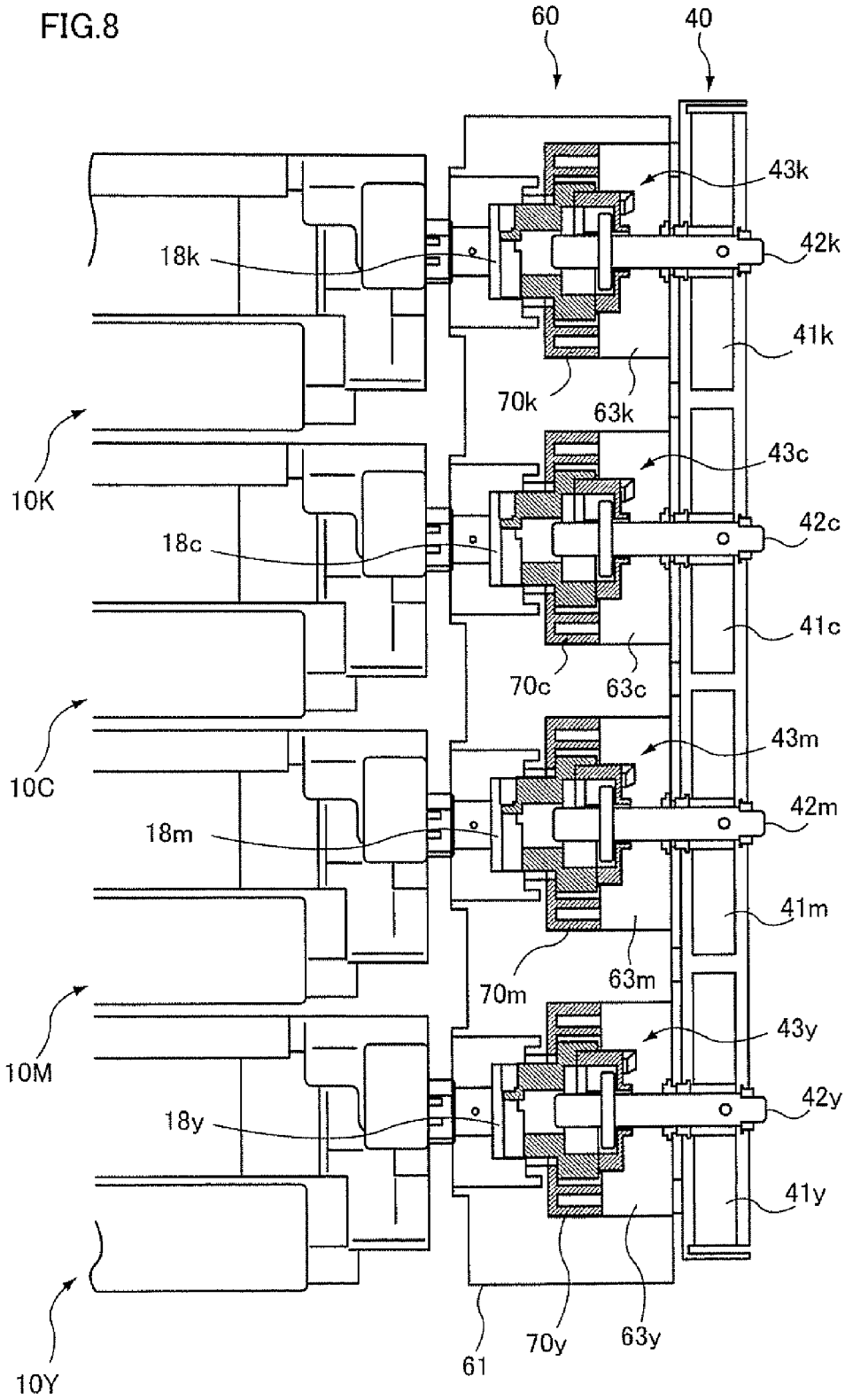
FIG. 8 is a view that shows the inside of the switching unit in the first state.

Here, FIG. 8 is a view that shows the inside of the switching unit 60 in the first state.

As mentioned above, the switching unit 60 in the first exemplary embodiment is provided with four storing portions 63*y*, 63*m*, 63*c* and 63*k* that store the advancing/retreating members 70*y*, 70*m*, 70*c* and 70*k* in the housing 61, respectively. In the first exemplary embodiment, in the inside of the storing portions 63, drive side coupling members 43*y*, 43*m*, 43*c* and 43*k* are arranged.

The respective drive side coupling members 43 are attached to the shafts 42*y*, 42*m*, 42*c*, 42*k*, and pushed to the respective photoconductor side coupling members 18 by a coil spring (not shown in the figure). Thereby, the respective drive side coupling members 43 are interconnected with the corresponding photoconductor side coupling members 18. In the first state, as shown in the figure, all the drive side coupling members 43 are interconnected with the corresponding photoconductor side coupling members 18, and all the photoconductor drums 11 are rotated and driven. Therefore, in the first state, the image formation by use of all image forming units 10, that is, the image formation in full colors is implemented.

Further, the inside structures of the switching unit 60 and the like are explained.

Figure 9:
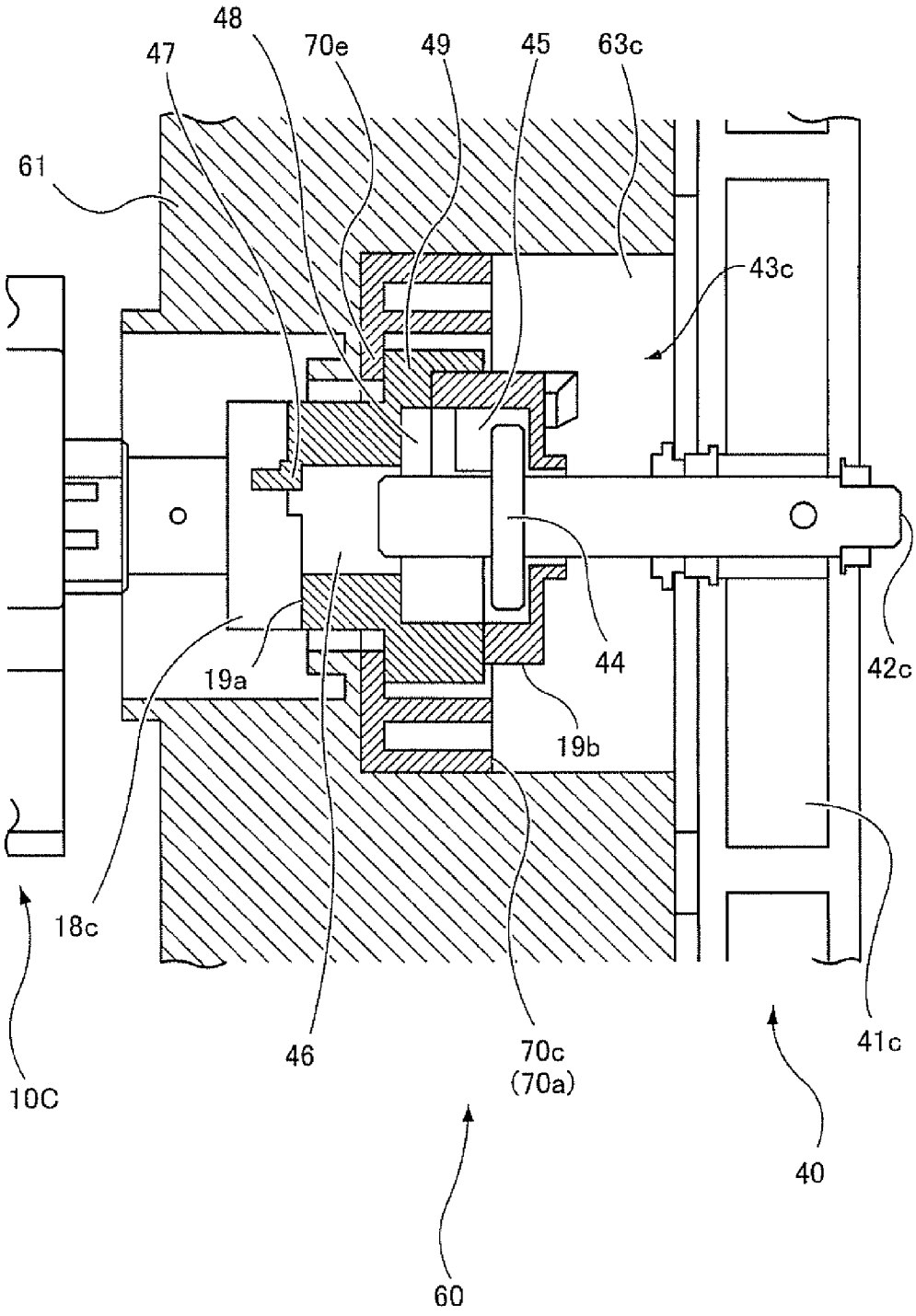
FIG. 9 is an enlarged view that shows the peripheral of the drive side coupling member in FIG. 8.

FIG. 9 is an enlarged view that shows the peripheral of the drive side coupling member 43*c* in FIG. 8.

The drive unit 40 in the first exemplary embodiment is provided with a pin 44 which is arranged through the shaft 42*c* and whose both end portions protrude from the outer circumferential surface of the shaft 42*c*. The pin 44 is arranged in the inside of the drive side coupling member 43*c*, and is arranged so as to reach a hitting surface 45 formed in the inside of the drive side coupling member 43*c* when the shaft 42*c* is rotated and driven by the motor M3 (refer to FIG. 4). As a result, interlocking with the rotation of the shaft 42*c*, the drive side coupling member 43*c* also rotates.

The drive side coupling member 43*c* is arranged so as to be slidable along the axial direction of the shaft 42*c*. In more particular, the drive side coupling member 43*c* in the first exemplary embodiment is provided with a opening hole 46 in which the shaft 42*c* is arranged, which is formed with a larger diameter than that of the shaft 42*c*, and which is provided so as to penetrate from the drive unit 40 side to the image forming unit 10C side. In addition, the drive side coupling member 43*c*, as mentioned above, is provided with the hitting surface 45. The hitting surface 45 is formed to be flat, and arranged along the axial direction of the shaft 42*c*. Further, the drive side coupling member 43*c* is provided with an inward protruding portion 47 that protrudes in the opening hole 46, on the photoconductor side coupling member 18*c* side. The inward protruding portion 47 reaches the end portion of the shaft 42*c*, when the drive side coupling member 43*c* slides to the drive unit 40 side.

Further, the drive side coupling member 43*c* is provided with a concave slot 48 that is formed from the opening hole 46 to the outside of the drive side coupling member 43*c*, and arranged so as to surround the outer circumferential surface of the shaft 42*c*, on the side closer to the photoconductor side coupling member 18*c* than the hitting surface 45. When the drive side coupling member 43*c* slides to the drive unit 40 side and the inward protruding portion 47 reaches the end portion of the shaft 42*c*, the pin 44 is rotatably arranged in the concave slot 48. Further, the drive side coupling member 43*c* is provided with an outward protruding portion 49 that protrudes outside, on the outer circumferential portion thereof.

On the other hand, the advancing/retreating member 70*c* in the first exemplary embodiment is provided with an inward protruding portion 70*e* that protrudes inward, on the inner circumferential surface of the ring portion 70*a*.

The drive side coupling member 43*c* in the first exemplary embodiment is arranged in the inside of the ring portion 70*a*. The drive side coupling member 43*c* is pushed by the coil spring (not shown in the figure), and as a result, the outward protruding portion 49 reaches the inward protruding portion 70*e*, and the advancing/retreating member 70*c* reaches the housing 61. As a result, the drive side coupling member 43*c* is positioned to a predetermined position in the storing portion 63*c*. Further, the end portion of the drive side coupling member 43*c* is exposed from the advancing/retreating member 70*c*, and this end portion is interconnected to the photoconductor side coupling member 18*c*.

The drive side coupling member 43*c* in the first exemplary embodiment is configured by assembling two members of an interconnecting member 19*a* interconnected to the photoconductor side coupling member 18*c*, and a supporting member 19*b* that supports the interconnecting member 19*a*.

Here, in the first state (refer to FIGS. 6 and 7), when the first drive gear 81 is rotated and driven, the first movable plate 83 receives the drive force from the first drive gear 81, and slides upward. As a result, the first protruding portion 83*a* formed on the first movable plate 83 moves upward in the upper long hole 84*b*, the second protruding portion 83*b* moves upward in the middle long hole 84*c*, and the third protruding portion 83*c* moves upward in the lower long hole 84*d*. Further, as the first protruding portion 83*a*, the second protruding portion 83*b* and the third protruding portion 83*c* move upward, the respective advancing/retreating members 70*y*, 70*m* and 70*c* rotate in the arrow A direction in FIG. 7. The sliding of the second movable plate 84 is regulated by the second drive gear 82 arranged in a state where the second drive gear 82 interlocks with the cover 2, when the first movable plate 83 slides.

Figure 10:
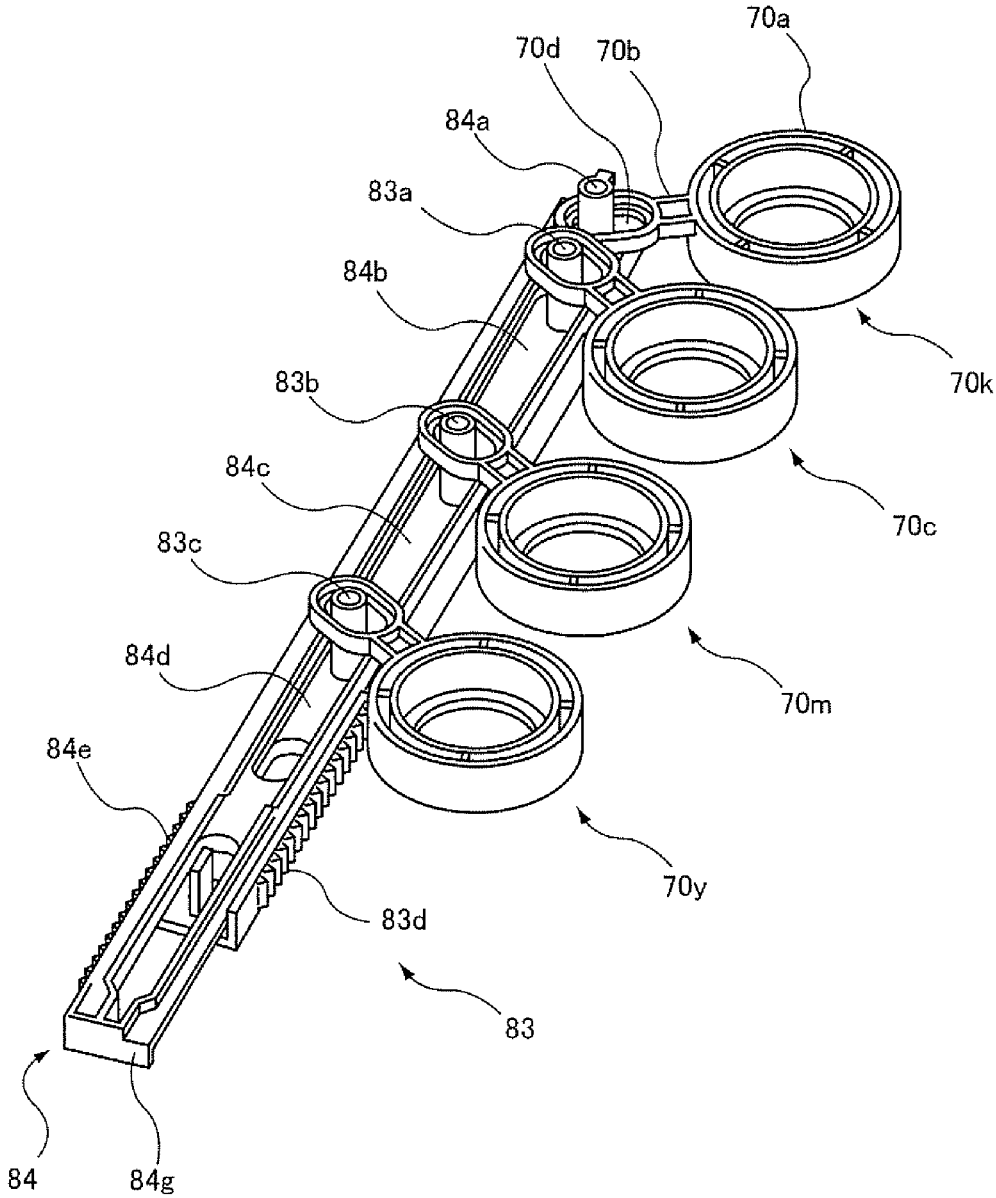
FIG. 10 is a perspective view that shows the advancing/retreating members, the first movable plate and the second movable plate after the first drive gear is rotated and driven.
Figure 11:
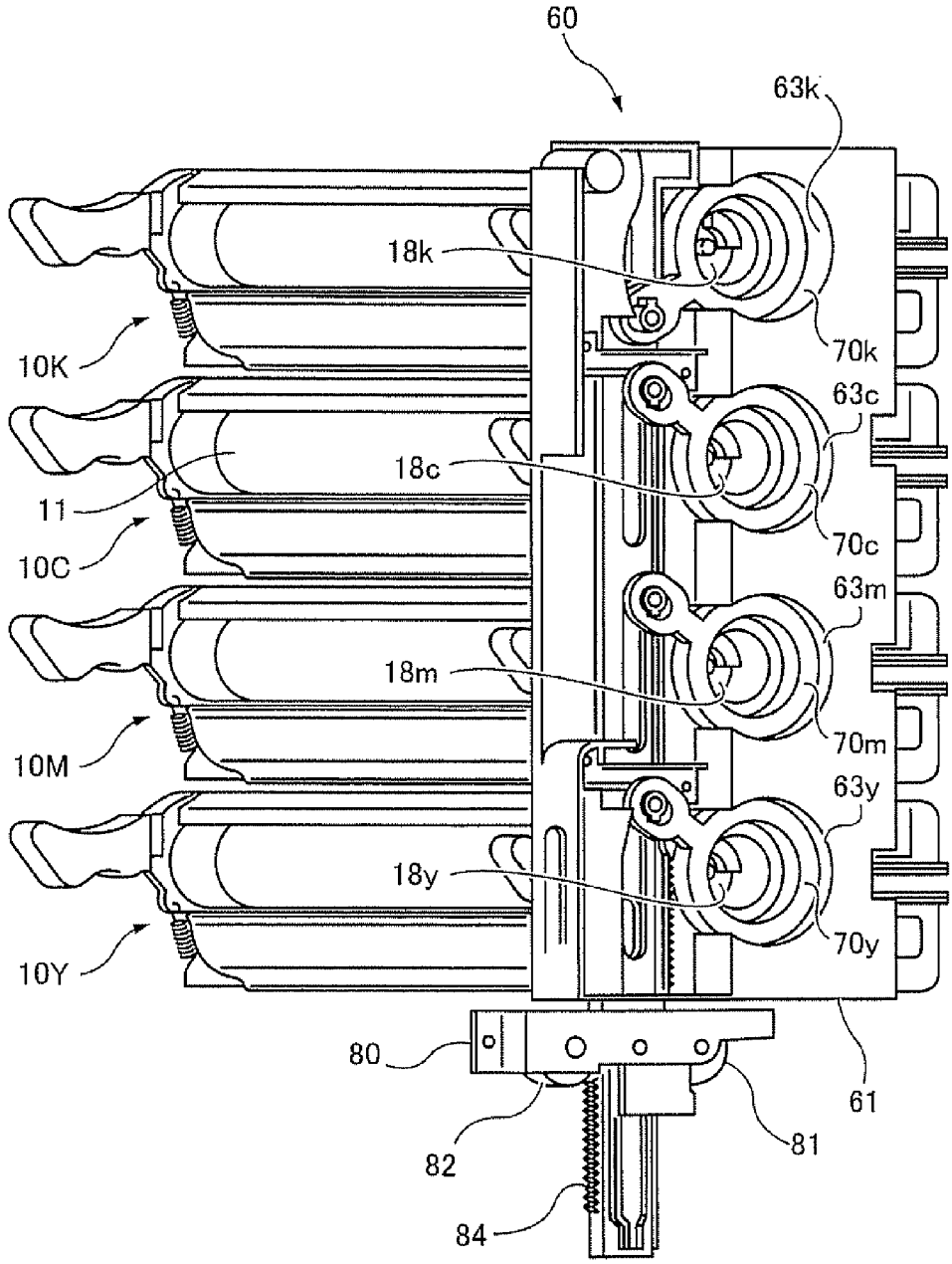
FIG. 11 is a perspective view that shows the switching unit and the like after the first drive gear is rotated and driven, viewed from the drive unit side.

When the upward sliding of the first movable plate 83 is complete, the state becomes one shown in FIG. 10 and FIG. 11. Here, FIG. 10 is a perspective view that shows the advancing/retreating members 70, the first movable plate 83 and the second movable plate 84 after the first drive gear 81 is rotated and driven. FIG. 11 is a perspective view that shows the switching unit 60 and the like after the first drive gear 81 is rotated and driven, viewed from the drive unit 40 side (refer to FIG. 5).

When the first movable plate 83 slides upward, as mentioned above, the first protruding portion 83*a* moves upward in the upper long hole 84*b*, the second protruding portion 83*b* moves upward in the middle long hole 84*c*, and the third protruding portion 83*c* moves upward in the lower long hole 84*d*. Further, the respective advancing/retreating members 70 except the advancing/retreating member 70*k* rotate in the arrow A direction as mentioned above. As a consequence, as shown in FIG. 10 and FIG. 11, the first protruding portion 83*a* is positioned in the upper portion of the upper long hole 84*b*, and the second protruding portion 83*b* is positioned in the upper portion of the middle long hole 84*c*, and the third protruding portion 83*c* is positioned in the upper portion of the lower long hole 84*d*. Furthermore, the arm portions 70*b* in the advancing/retreating members 70*y*, 70*m* and 70*c* are directed diagonally upward (hereinafter, this state is referred to as "a second state").

Figure 12:
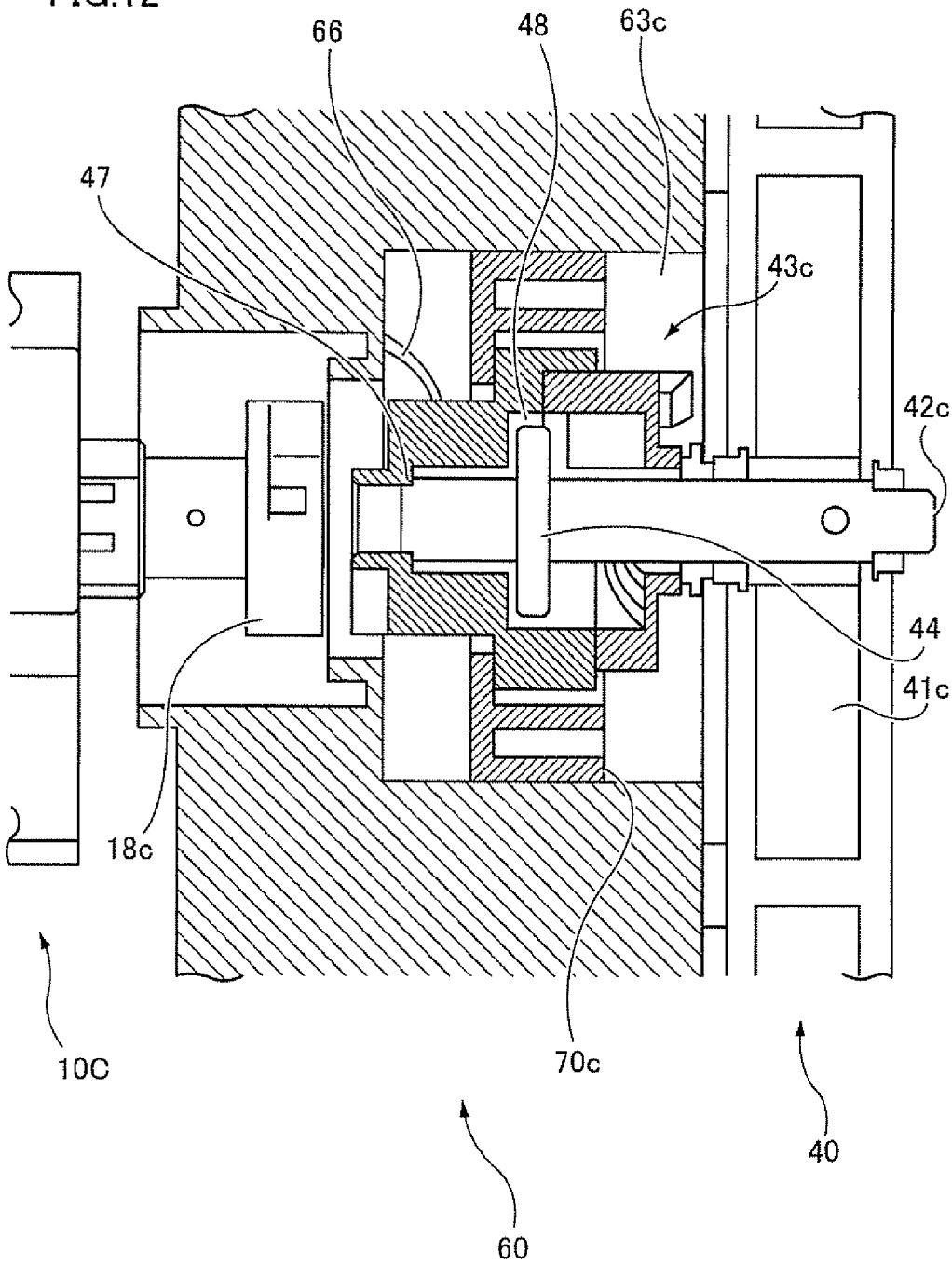
FIG. 12 is a view that shows the inside of the storing portion in the second state.

Here, FIG. 12 is a view that shows the inside of the storing portion 63*c* in the second state.

Although explanations are omitted in FIG. 9, the switching unit 60 in the first exemplary embodiment is provided with a guide protrusion 66 that is arranged to protrude inward and formed in a spiral shape, in the inside wall of the storing portion 63*c*. Further, as mentioned above, when the first movable plate 83 (refer to FIG. 10) slides upward and the advancing/retreating member 70*c* rotates, the advancing/retreating member 70*c* is guided by the guide protrusion 66, and moves (retreats) in the direction leaving from the photoconductor side coupling member 18*c*. Then, when the advancing/retreating member 70*c* moves in the direction leaving from the photoconductor side coupling member 18*c*, the drive side coupling member 43*c* also moves (slides) in the direction leaving from the photoconductor side coupling member 18*c*.

As a result, in the second state, as shown in FIG. 12, the interconnection of the photoconductor side coupling member 18*c* and the drive side coupling member 43*c* is in a released state. Therefore, the rotation of the photoconductor drum 11 (refer to FIG. 11) by the drive side coupling member 43*c* is also stopped. Further, in the second state, since the pin 44 is positioned in the concave slot 48, the rotation of the drive side coupling member 43*c* is stopped. In addition, in the second state, as shown in FIG. 3B, the paper transportation belt 30 gets in a state where the paper transportation belt 30 is separated from the photoconductor drums 11 in the image forming units 10Y, 10M and 10C. Therefore, the rotation of the photoconductor drum 11 by the paper transportation belt 30 is also stopped.

Meanwhile, in the shift from the first state to the second state, the rotation of the advancing/retreating member 70*k* is not carried out (refer to FIG. 10 and FIG. 11). Therefore, in the second state, the interconnection of the photoconductor side coupling member 18*k* and the drive side coupling member 43*k* is maintained, and the interconnection of the photoconductor side coupling members 18*y*, 18*m* and 18*c*, and the drive side coupling members 43*y*, 43*m* and 43*c* is released. As a result, in the second state, only the photoconductor drum 11 in the image forming unit 10K is rotated and driven, and the image formation by use of the image forming unit 10K, that is, the image formation in a single color is implemented.

Here, the second drive gear 82 (refer to FIG. 11) is configured so as to be rotated and driven interlocking with the cover 2, when the cover 2 (refer to FIG. 1) is opened. When the second drive gear 82 is rotated and driven interlocking with the opening of the cover 2, the first movable plate 83 and the second movable plate 84 move upward, and all the interconnections of the drive side coupling members 43 and the photoconductor side coupling members 18 are released. Hereinafter, this configuration is explained.

Figure 13:
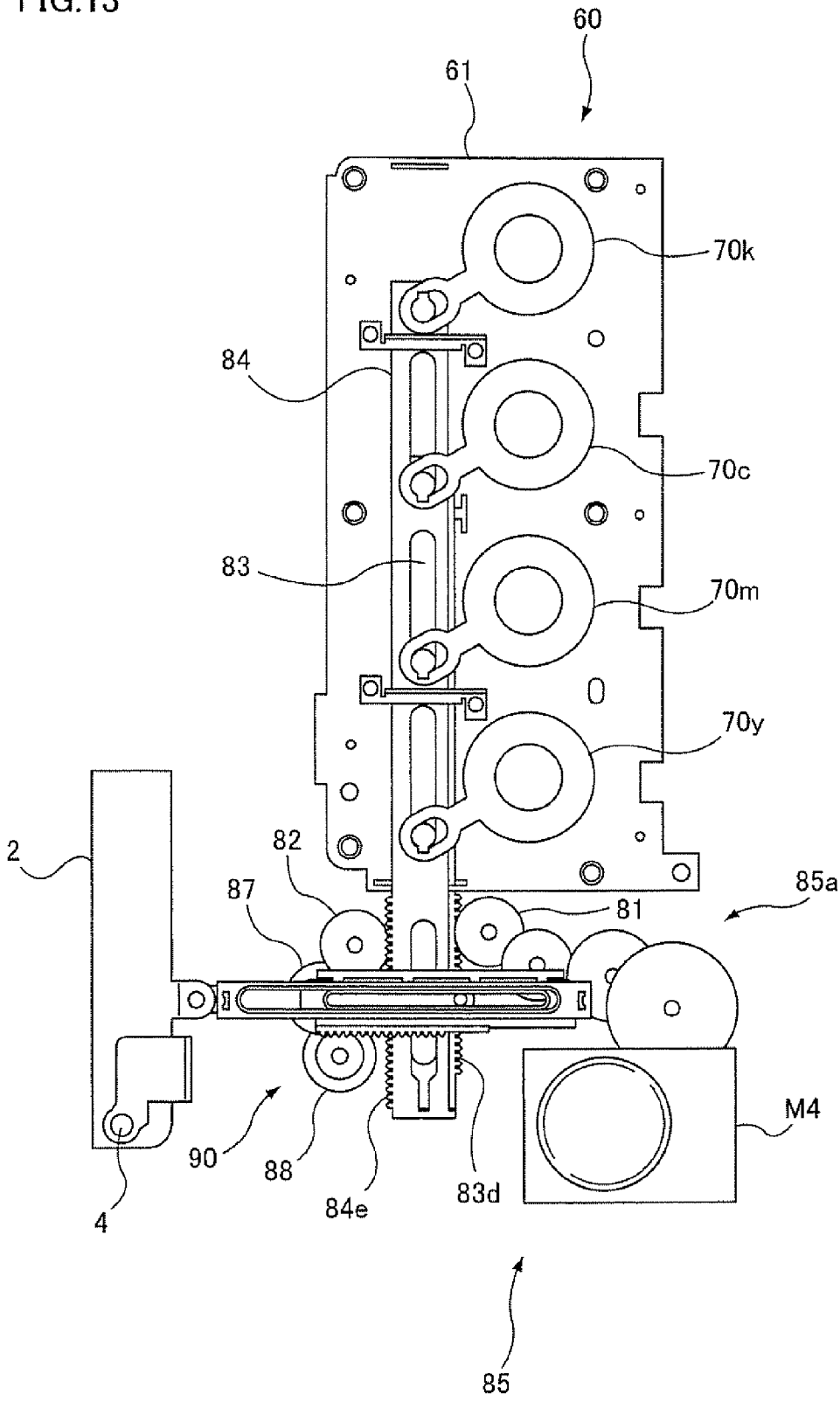

FIG. 13 is a side view that shows the side portion of the switching unit 60, including the cover 2 and the like. Note that in this figure, the cover 2 is simply illustrated.

As mentioned above, in the first exemplary embodiment, the first drive gear 81 that engages with the rack gear portion 83*d* provided on the first movable plate 83, and the second drive gear 82 that engages with the rack gear portion 84e provided on the second movable plate 84 are arranged.

Further, in the first exemplary embodiments a drive apparatus 85 that rotates and drives the first drive gear 81 is arranged. The drive apparatus 85 is provided with a motor M4, and a transmission gear 85*a* that is configured by plural gears and transmits the drive force generated by the motor M4 to the first drive gear 81. Meanwhile, the shift from the first state to the second state is carried out by the first drive gear 81 that is rotated and driven by the drive apparatus 85.

Further, in the first exemplary embodiment, by rotating and driving the first drive gear 81 in the reverse direction by the drive apparatus 85, the shift from the second state to the first state is also performed. As a result, the image forming apparatus 1 (refer to FIG. 1) in the first exemplary embodiment switches the image formation in a single color and the image formation in full colors.

Furthermore, in the first exemplary embodiment, a first gear 87 that is arranged rotatably and engages with the second drive gear 82, and a second gear 88 that is similarly arranged rotatably and engages with the first gear 87 are arranged. Moreover, a rotation mechanism 90 that rotates and drives the second gear 88 when the cover 2 is opened is arranged.

Figure 14A:
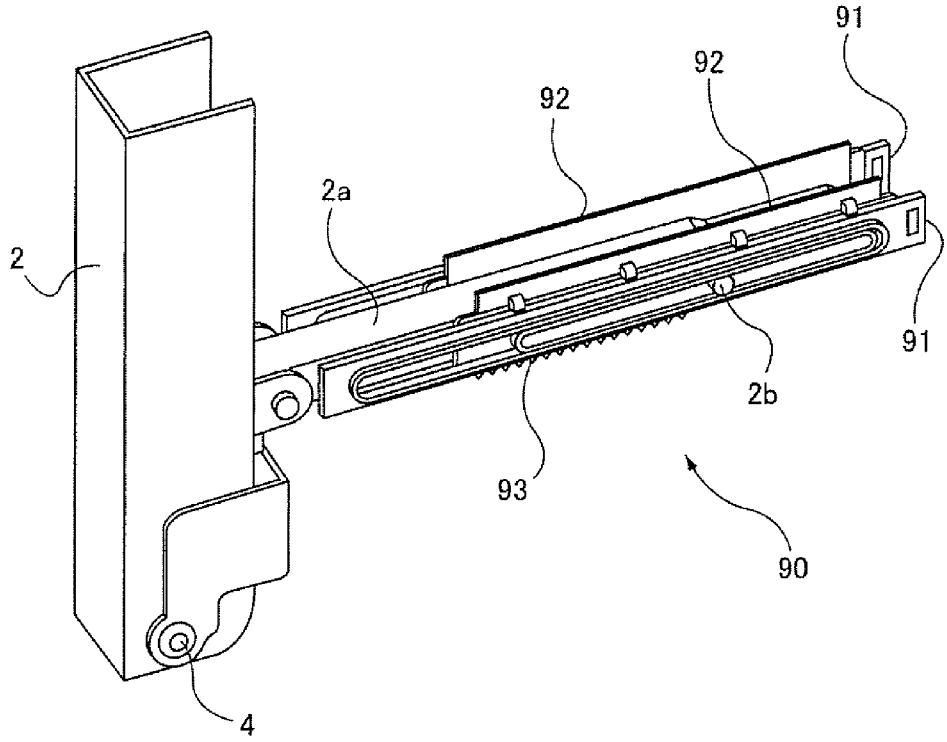
FIGS. 14A and 14B are views for explaining the rotation mechanism.
Figure 14B:
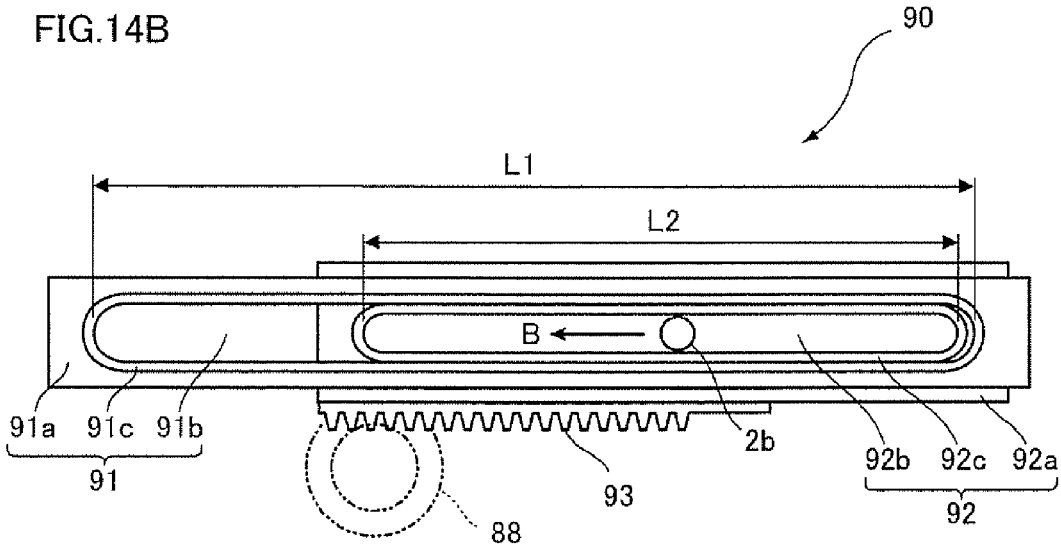

Here, FIGS. 14A and 14E are views for explaining the rotation mechanism 90. In addition, FIG. 14A is a perspective view that shows the rotation mechanism 90 including the cover 2, and FIG. 14B is a side view of the rotation mechanism 90.

The rotation mechanism 90 in the first exemplary embodiment is provided with a interlocking arm 2*a* whose one end portion is attached to the rear portion of the cover 2, and that moves interlocking with the opening and closing operations of the cover 2, and a penetration shaft 2*b* that is arranged through the inside of the other end portion of the interlocking arm 2*a*. Further, the rotation mechanism 90 is provided with a third movable plate 92 that is slidably arranged, a guide member 91 that guides the third movable plate 92, and a rack gear member 93 that is attached to the lower side of the third movable plate 92 and that engages with the second gear 88. Note that in FIG. 14B, the illustration of the cover 2 and the interlocking arm 2*a* is omitted, and the third movable plate 92 is simply illustrated.

Two guide members 91 in the first exemplary embodiment are arranged on both sides of the interlocking arm 2*a*. Further, the guide member 91 is fixed to t the apparatus main body 3 side (refer to FIG. 1). Each of the guide members 91 is provided with a guide main body portion 91*a* that is formed into a long plate shape, and fixed to the apparatus main body 3, a guide side long hole 91*b* that is arranged through the guide main body portion 91*a* and formed in the longitudinal direction of the guide main body portion 91*a*, and a guide side protruding portion 91*c* that is formed so as to surround the guide side long hole 91*b* and regulates the sliding direction of the third movable plate 92.

On the other hand, two third movable plates 92 are arranged on both sides of the interlocking arm 2*a*, in the same manner as the guide member 91. Further, the third movable plates 92 are arranged between the interlocking arm 2*a* and the guide member 91. Each of the third movable plates 92 is provided with a plate side main body portion 92*a* that is formed into a long plate shape, and a plate side long hole 92*b* that is arranged through in the plate side main body portion 92*a* and formed in the longitudinal direction of the plate side main body portion 92*a*. In addition, in the inside of the plate side long hole 92*b*, the penetration shaft 2*b* is arranged. Moreover, the full length L2 of the plate side long hole 92*b* is formed smaller than the full length L1 of the guide side long hole 91*b*.

Further, each of the third movable plates 92 is provided with a plate side protruding portion 92*c* that is formed so as to surround the plate side long hole 92*b* and arranged so as to protrude in the inside of the guide side long hole 91*b*. The plate side protruding portion 92*c* is arranged so as to be brought in contact with the guide side protruding portion 91*c*, and regulates the sliding direction of the third movable plate 92 together with the guide side protruding portion 91*c*.

The rack gear member 93 is arranged to lie astride both plate side main body portions 92*a*, and fixed to the lower edge portion of the plate side main body portions 92*a*.

For example, when the image formation in full colors is finished, as shown in the figure, the third movable plate 92 is positioned at the right side of the guide member 91 in the figure, and the penetration shaft 2*b* is arranged at the center in the longitudinal direction of the plate side long hole 92*b*. Then, when the cover 2 is opened from this state, the penetration shaft 2*b* moves in the direction shown by the arrow B in the figure interlocking with the interlocking arm 2*a*. Hereinafter, the operation of the rotation mechanism 90 is explained in detail.

Figure 15A:
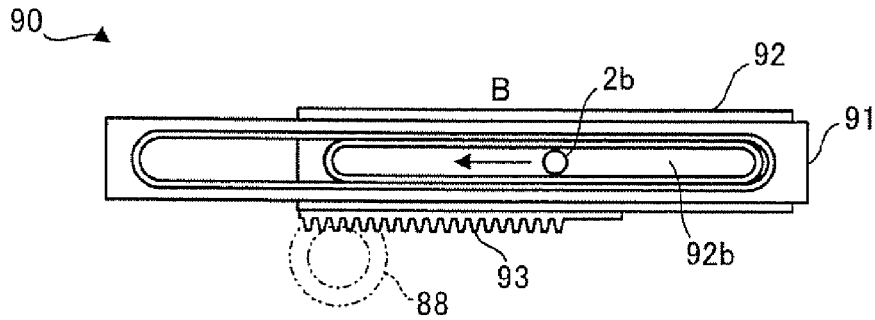
FIGS. 15A to 15E are views for explaining the operation of the rotation mechanism.

FIGS. 15A to 15E are views for explaining the operation of the rotation mechanism 90. FIG. 15A shows the same state as FIG. 14B.

When the cover 2 (refer to FIG. 14A) is opened in the state of FIG. 15 A, the interlocking arm 2*a* also moves interlocking with the cover 2. As a result, as shown by the arrow B in the figure, the penetration shaft 2*b* moves in the direction to the left end portion of the plate side long hole 92*b*.

Figure 15B:
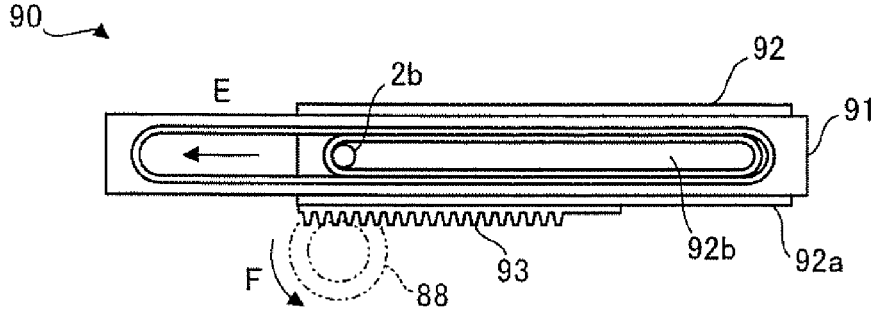

Then, when the cover 2 is further opened, as shown in FIG. 15B, the penetration shaft 2*b* reaches the plate side main body portion 92*a*, at the left end portion of the plate side long hole 92*b*. Moreover, when the cover 2 is further opened, the movement of the third movable plate 92 to the left side in the figure (refer to the arrow E) is started together with the movement of the penetration shaft 2*b*.

When the movement of the third movable plate 92 to the left side is started, the second gear 88 that engages with the rack gear member 93 starts rotating in the direction shown by the arrow F in the figure. Then, when the rotation of the second gear 88 is started, the rotation of the second drive gear 82 (refer to FIG. 13) is also started, and the second movable plate 84 starts sliding upward. Further, along with the upward sliding of the second movable plate 84, the upward sliding of the first movable plate 83 is also started.

Figure 15C:
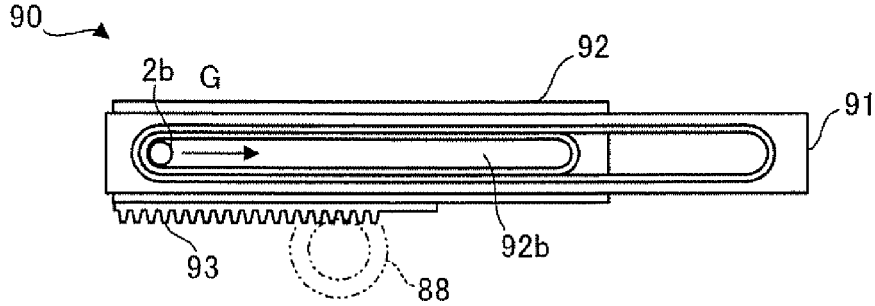

When the cover 2 is opened completely, as shown in FIG. 15C, the third movable plate 92 positions to the left side of the guide member 91, and the upward sliding of the first movable plate 83 and the second movable plate 84 (refer to FIG. 13) is completed.

Further, when the closing operation of the cover 2 is started from the state in FIG. 15C, the penetration shaft 2*b* moves in the direction shown by the arrow G in the figure, through the plate side long hole 92*b*. Then, when the cover 2 is closed completely, the penetration shaft 2*b* is arranged to the right end of the plate side long hole 92*b*, as shown in FIG. 15D.

Meanwhile, the rotation mechanism 90 in the first exemplary embodiment is configured so that, when the cover 2 is closed, the penetration shaft 2*b* does not reach the plate side main body portion 92*a* (refer to FIG. 14B). As a result, by the closing operation of the cover 2, the sliding of the third movable plate 92 is not carried out. Therefore, by the closing operation of the cover 2, the rotation and drive of the second gear 88 are not carried out, and the rotation and drive of the second drive gear 82 (refer to FIG. 13) and the sliding of the second movable plate 84 are not carried out.

Figure 15D:
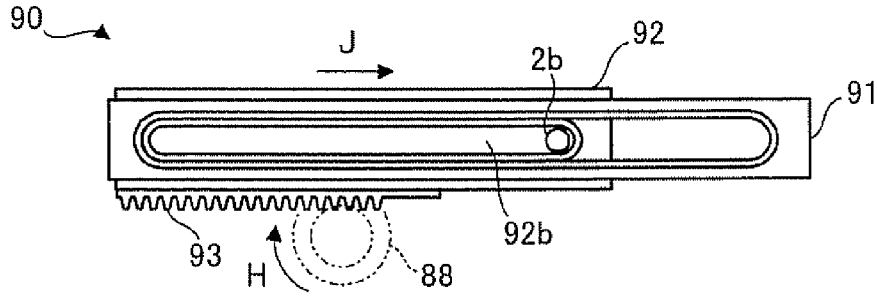
Figure 15E:
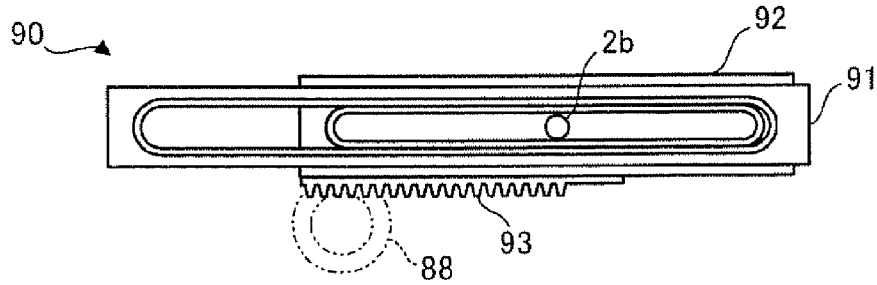

Further, as shown in FIG. 15D, when the second gear 88 is rotated and driven in the direction shown by the arrow H in the figure, the third movable plate 92 slides to the right side in the figure (refer to the arrow J). As a result, the rotation mechanism 90 gets in its initial state (the state shown in FIG. 15A). In addition, although details are described later herein, the rotation and drive of the second gear 88 is carried out by the downward sliding of the second movable plate 84 (refer to FIG. 13).

Here, with reference to FIGS. 15A to 15E, the operation of the advancing/retreating member 70 and the like when the opening and closing operation of the cover 2 is carried out is explained.

Figure 16:
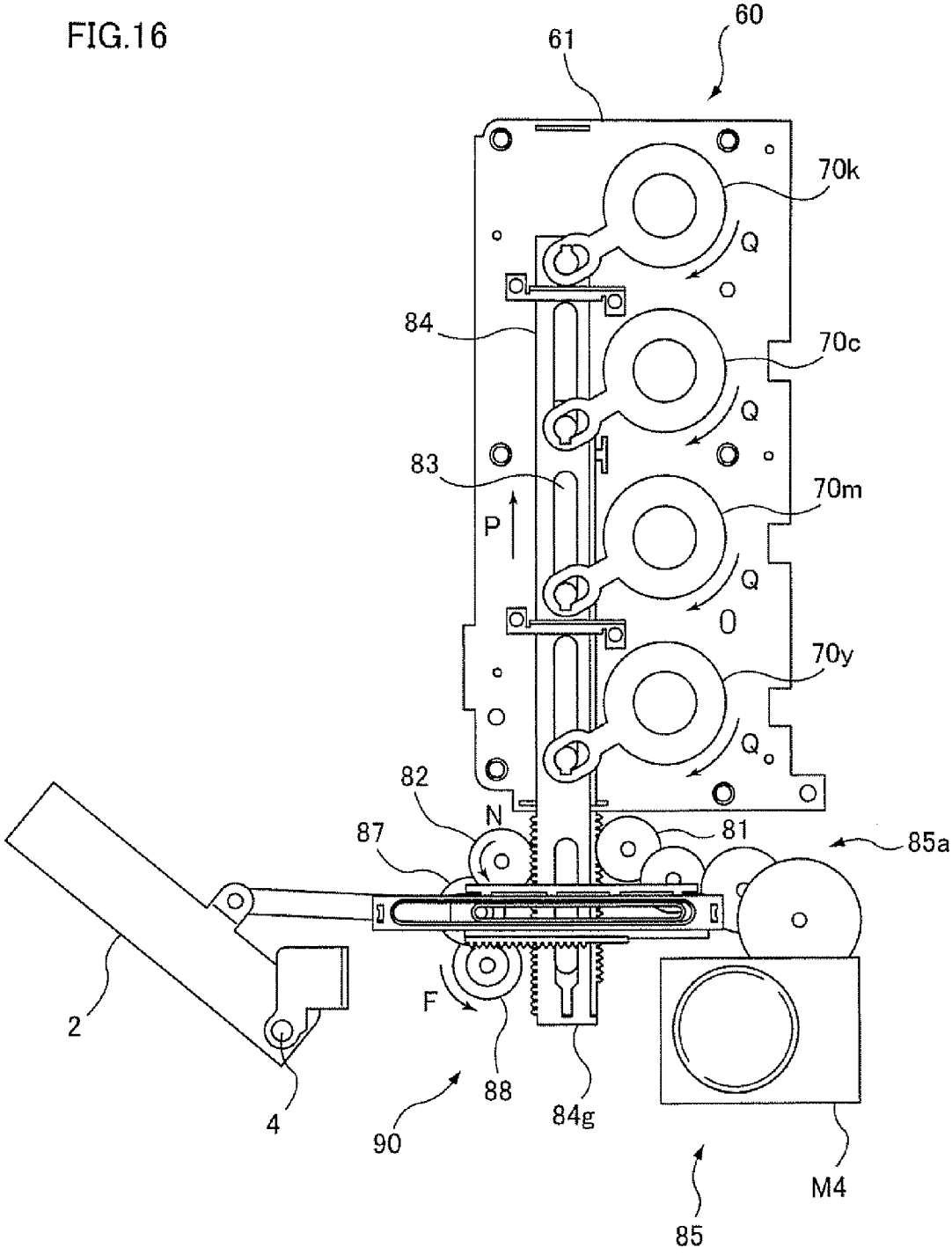
FIG. 16 is a view that shows the side portion of the switching unit when the rotation mechanism is in the state of FIG. 15B.

FIG. 16 is a view that shows the side portion of the switching unit 60 when the rotation mechanism 90 is in the state of FIG. 15B. When the opening of the cover 2 is started, as already explained with reference to FIG. 15A, the penetration shaft 2*b* moves in the direction to the left end portion of the plate side long hole 92*b*. As a result, the rotation mechanism 90 gets in the state shown in FIG. 15B, and the cover 2 and the like get in the state shown in FIG. 16.

When the cover 2 is further opened from the state shown in FIG. 16, as already explained with reference to FIG. 15B, the third movable plate 92 slides in the direction shown by the arrow E, and the second gear 88 rotates in the direction shown by the arrow F. As a result, as shown in FIG. 16, the second drive gear 82 starts rotating in the direction shown by the arrow N in the figure. Therefore, the upward sliding (refer to the arrow P in the figure) of the second movable plate 84 is also started. Further, the first movable plate 83 is pushed by the stopping portion 84*g* as an example of the interlocking portion, and also starts sliding upward. Furthermore, along with the upward sliding of the first movable plate 83 and the second movable plate 84, the respective advancing/retreating members 70 start rotating in the direction shown by the arrow Q in the figure.

Figure 17:
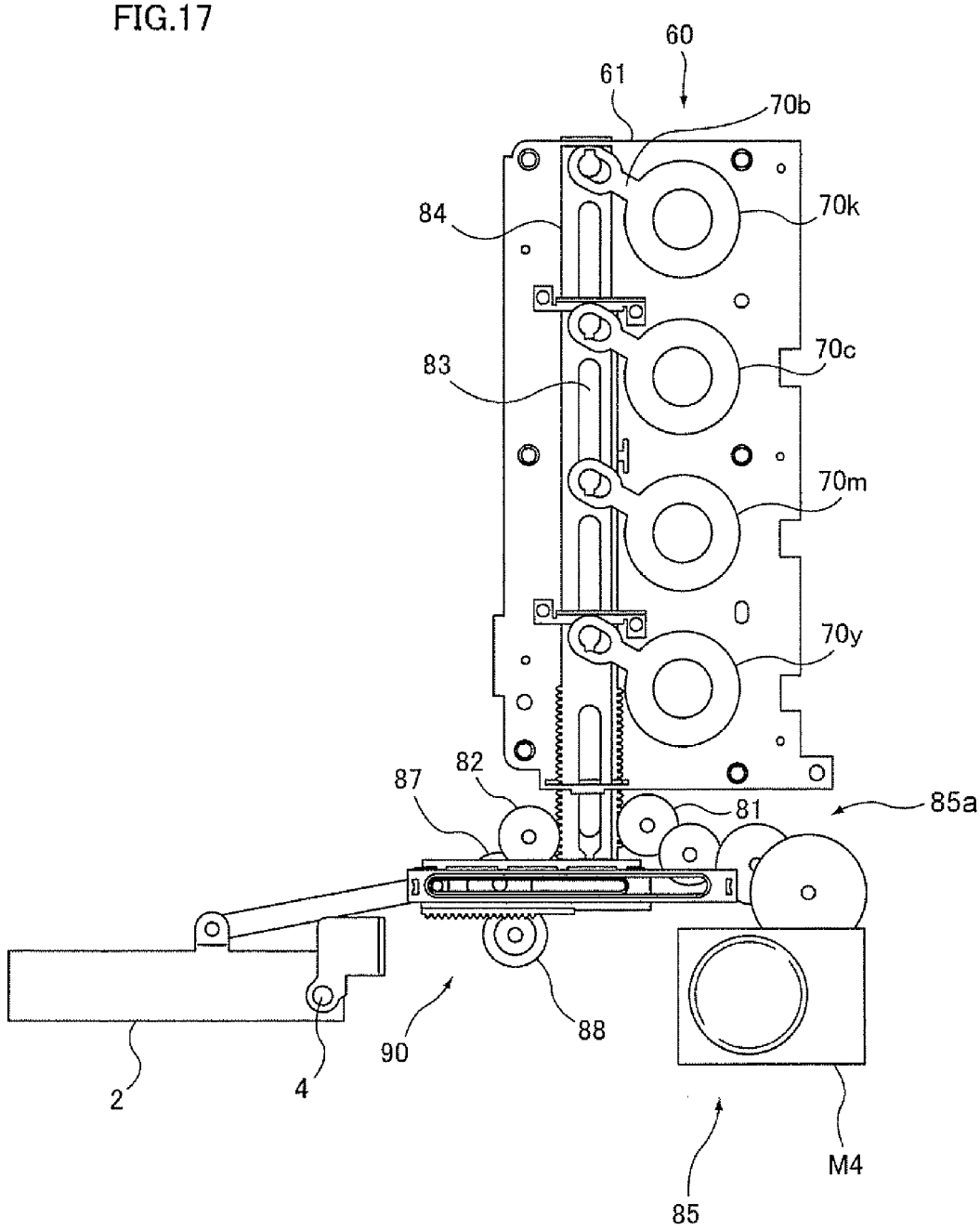
FIG. 17 is a view that shows the side portion of the switching unit.
Figure 18:
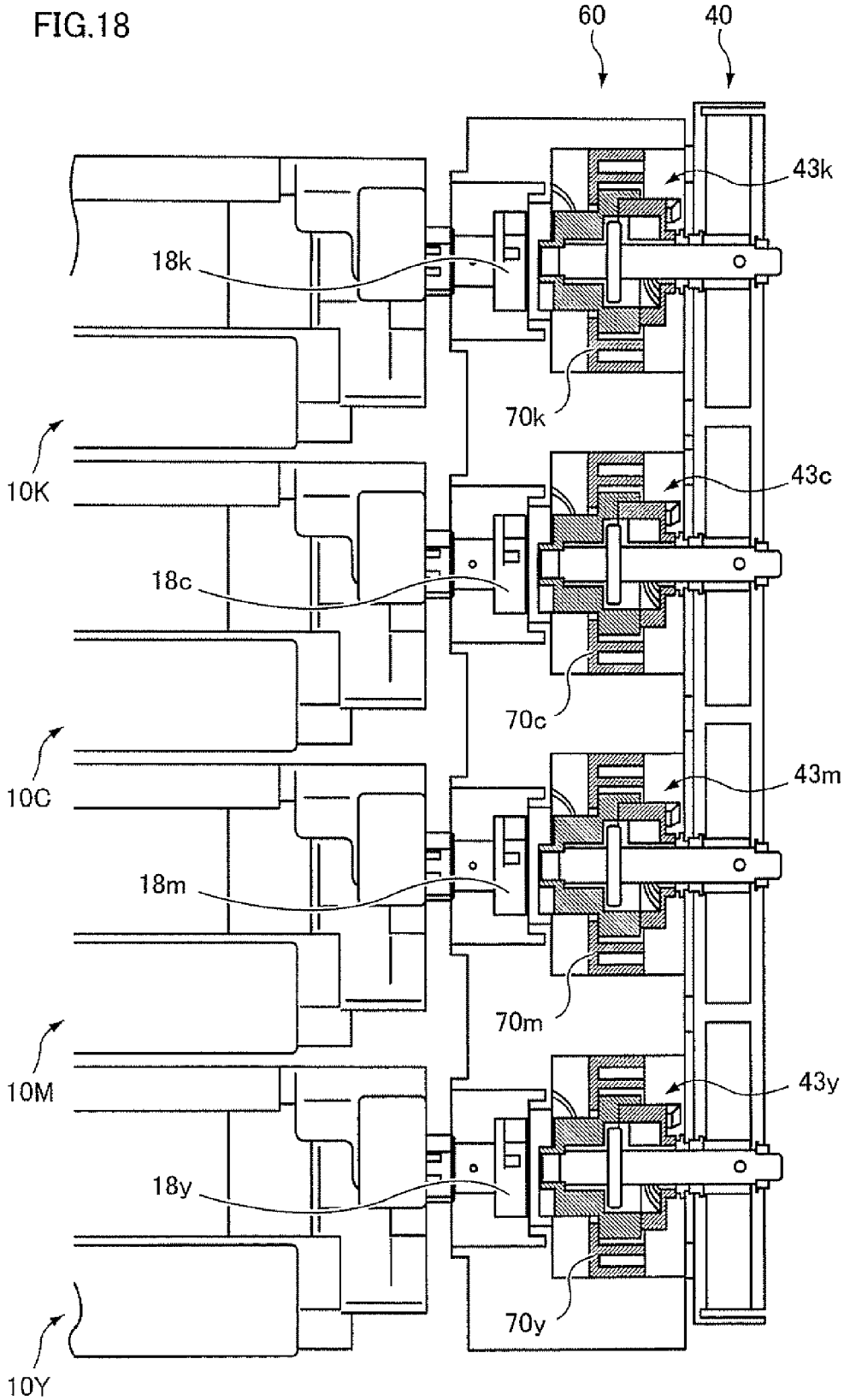
FIG. 18 is a view that shows the inside of the switching unit.

Here, FIGS. 17 and 18 show the state after the opening of the cover 2 is completed. FIG. 17 is a view that shows the side portion of the switching unit 60, and FIG. 18 is a view that shows the inside of the switching unit 60.

When the opening of the cover 2 is completed, the rotation mechanism 90 gets in the state shown in FIG. 15C, and the upward sliding of the first movable plate 83 and the second movable plate 84 is completed. Then, when the upward sliding of the first movable plate 83 and the second movable plate 84 is completed, the rotation of the advancing/retreating members 70 is completed, and as shown in FIG. 17, the arm portions 70*b* are directed diagonally upward.

As a result, all the drive side coupling members 43 slide to the drive unit 40 side, and as shown in FIG. 18, all the interconnections of the drive side coupling member 43 and the photoconductor side coupling members 18 get in the released state. In addition, when the opening of the cover 2 is completed, as already shown in FIG. 2, the image forming unit 10 gets in an exposed state. Therefore, by the opening of the cover 2, the user and the like may exchange the image forming unit 10.

Figure 19:
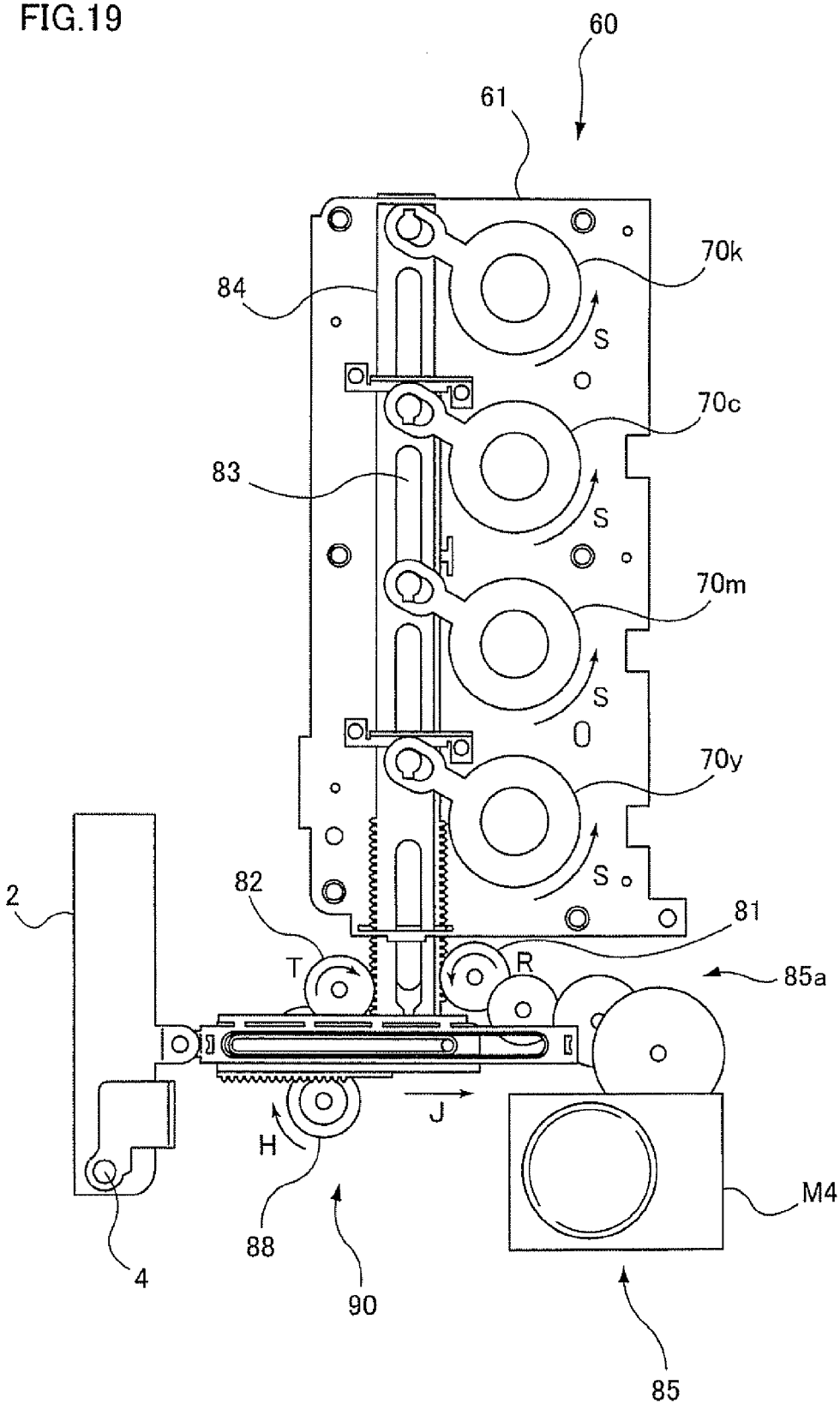
FIG. 19 is a view that shows the side portion of the switching unit.

When the image forming unit 10 is exchanged and the cover 2 is closed, the rotation mechanism 90 gets in the state shown in FIG. 15D and the side portion of the switching unit 60 gets in the state shown in FIG. 19 (a view that shows the side portion of the switching unit 60). As already explained with reference to FIG. 15D, when the cover 2 is closed, the sliding of the third movable plate 92 is not carried out, and, the rotation and drive of the second drive gear 82 and the like are not carried out. As a result, since the rotation of the advancing/retreating members 70 is not carried out, even if the closing operation of the cover 2 is carried out, the interconnection of the drive side coupling member 43 and the photoconductor side coupling members 18 is not carried out, but left released.

When the cover 2 is closed completely and a predetermined output is made from a sensor (not shown in the figure), the first drive gear 81 is rotated and driven by the drive apparatus 85 in the direction shown by the arrow R in the figure. As a result, the downward sliding of the first movable plate 83 is started, and by the sliding of the first movable plate 83, the downward sliding of the second movable plate 84 is also started. As a result, the respective advancing/retreating members 70 start rotating in the direction shown by the arrow S in the figure. Further, by the downward sliding of the second movable plate 84, the second drive gear 82 starts rotating in the direction shown by the arrow T in the figure, and the second gear 88 starts rotating in the direction shown by the arrow H in the figure. As a result, as already shown in FIG. 15D, the third movable plate 92 slides in the direction shown by the arrow J in the figure.

Figure 20:
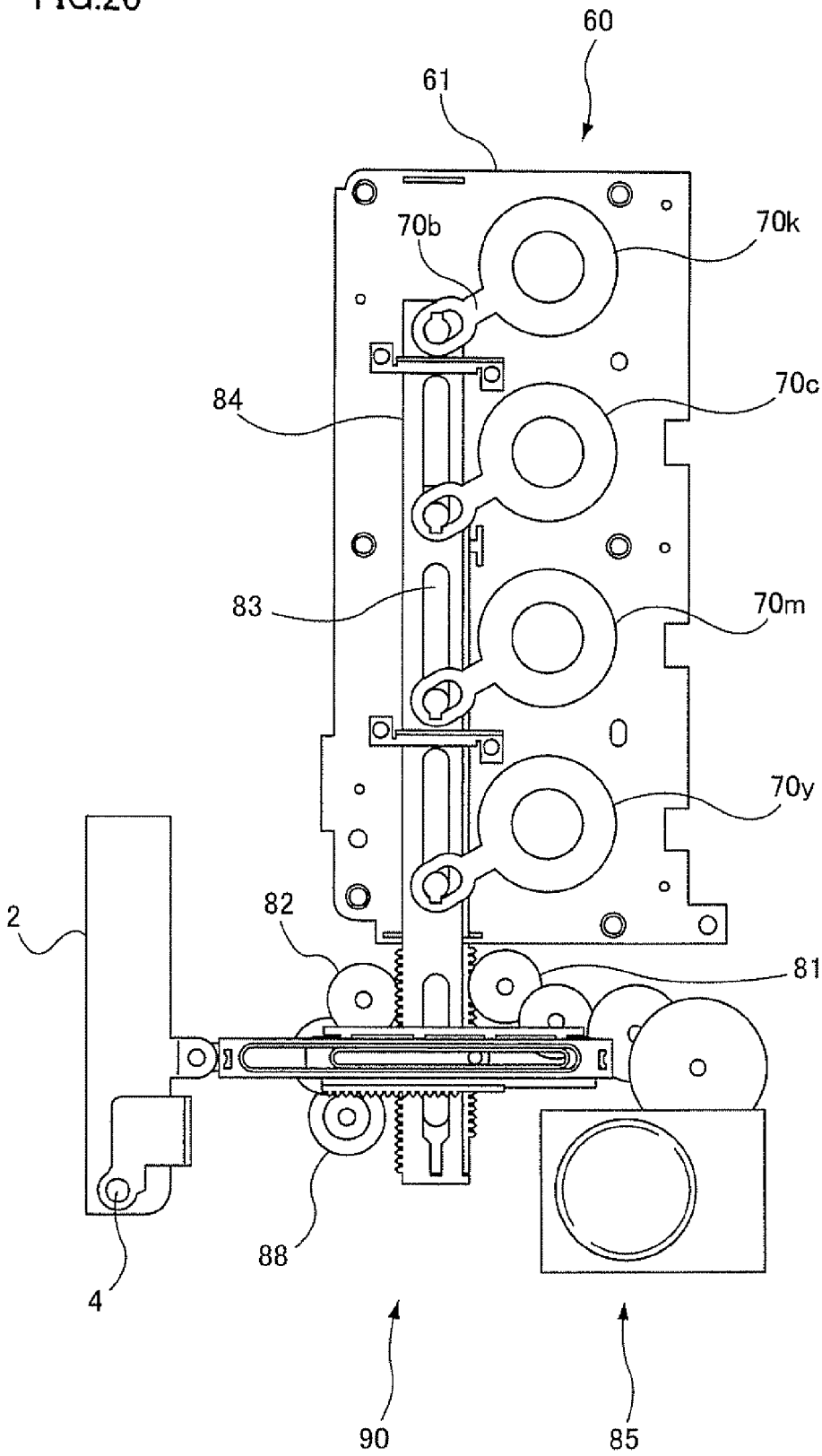
FIG. 20 is a view that shows the state after the downward sliding of the first movable plate and the second movable plate is completed.

FIG. 20 is a view that shows the state after the downward sliding of the first movable plate 83 and the second movable plate 84 is completed. As shown in the figure, when the downward sliding of the first movable plate 83 and the second movable plate 84 is completed, the rotation of the respective advancing/retreating members 70 is completed, and the arm portions 70*h* are directed diagonally downward. As a result, as already shown in FIG. 8, all of the photoconductor side coupling members 18 and the drive side coupling members 43 are interconnected.

Next, a second exemplary embodiment is explained.

Figure 21:
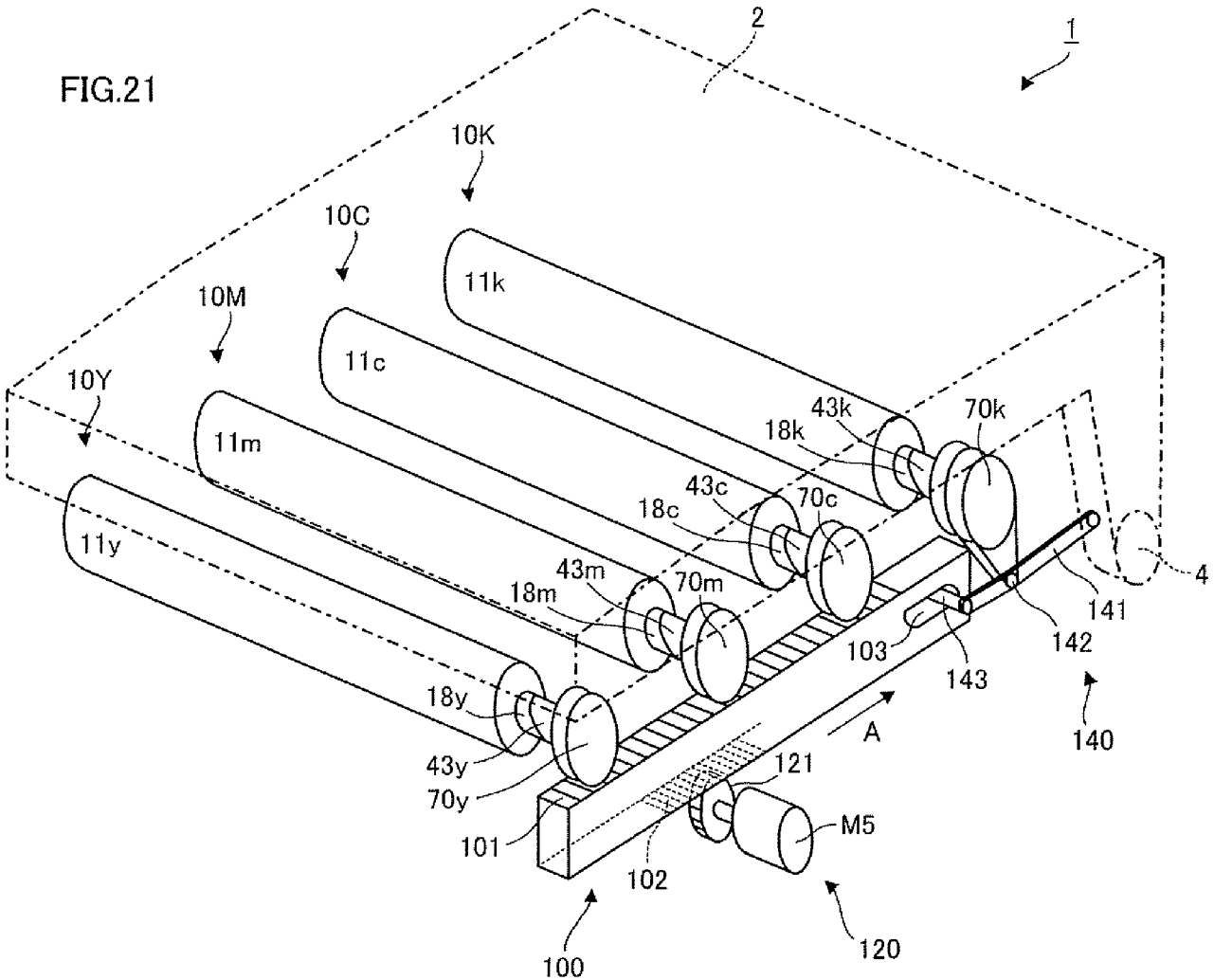
FIG. 21 is a view that schematically shows the image forming apparatus in the second exemplary embodiment.

FIG. 21 is a view that schematically shows the image forming apparatus 1 in the second exemplary embodiment. Note that, in the figure, portions being different from those in the first exemplary embodiment are mainly illustrated. Further, it should be noted that the same numerals are given to the same functions as those in the first exemplary embodiment for omitting the repeated explanations thereof in all drawings for explaining the embodiments. Furthermore, in the figure, photoconductor drums 11 provided in the image forming units 10Y, 10M, 10C and 10K are shown as 11*y*, 11*m*, 11*c* and 11*k* respectively.

As shown in the figure, in the second exemplary embodiment, in the same manner as in the first exemplary embodiment, four advancing/retreating members 70*y*, 70*m*, 70*c* and 70*k* are provided. However, the advancing/retreating members 70*y*, 70*m* and 70*c* in the second exemplary embodiment do not have the arm portions 70*b* and the opening holes 70*d* (refer to FIG. 7), and are in a state having only the ring portions 70*a*. Further, each of the advancing/retreating members 70*y*, 70*m* and 70*c* (ring portion 70*a*) is provided with a gear (not shown in the figure) that engages with a first rack gear 101 to be described later herein, on the outer circumferential edge. On the other hand, in the same manner as in the first exemplary embodiment, the advancing/retreating member 70*k* has the ring portion 70*a*, the arm portion 70*b* and the opening hole 70*d* (refer to FIG. 7).

Furthermore, in the image forming apparatus 1 in the second exemplary embodiment, the fulcrum 4 is provided not at the photoconductor drum 11*y* side, but at the photoconductor drum 11*k* side.

Moreover, the image forming apparatus 1 in the second exemplary embodiment is provided with a drive apparatus 120, a sliding member 100 that receives drive force from the drive apparatus 120 and the like and slides, and a link member 140 that makes the sliding member 100 slide interlocking with the opening operation and the closing operation of the cover 2.

The sliding member 100 is arranged along the arrangement direction of the photoconductor drums 11*y*, 11*m*, 11*c* and 11*k* arranged in parallel in a straight line, and is provided so as to slide in the arrangement direction. Further, the sliding member 100 is provided with, at one edge portion (an upper edge portion in the figure), the first rack gear 101 that engages with the above described gears provided on the advancing/retreating members 70*y*, 70*m* and 70*c* (ring portion 70*a*). Furthermore, the sliding member 100 is provided with, on the other edge portion (a lower edge portion in the figure), a second rack gear 102 that receives the drive force from the drive apparatus 120. Moreover, the sliding member 100 is provided with an opening hole 103, at the end portion of the side where the photoconductor drum 11*k* is provided. In addition, the opening hole 103 is formed as a long hole along the sliding direction of the sliding member 100.

The drive apparatus 120 is provided with a motor MS and a gear 121 that receives the drive force from the motor MS and rotates. In addition, the gear 121 is provided so as to engage with the above-mentioned second rack gear 102 in the sliding member 100.

The link member 140 is provided with a plate shaped portion 141 that is formed into a long and thin plate shape, a first protruding portion 142 that laterally protrudes from the plate shaped portion 141, and a second protruding portion 143 that laterally protrudes in the same manner. The plate shaped portion 141 is provided substantially along the sliding direction of the sliding member 100, and one end portion thereof is attached to the cover 2. The first protruding portion 142 is arranged through inside of the opening hole 70*d* (refer to FIG. 7) provided in the advancing/retreating member 70*k*. The second protruding portion 143 is arranged on the other end portion of the plate shaped portion 141, and arranged to be positioned in the inside of the opening hole 103 provided in the sliding member 100.

The figure shows the state where the cover 2 is closed and the sliding member 100 is positioned close to the left in the figure (close to the photoconductor drum 11*y*). In this state, all the drive side coupling members 43 and all the photoconductor side coupling members 18 are interconnected, and the image formation in full colors is performed. Here, in the state, the above-mentioned second protruding portion 143 is positioned on the photoconductor drum 11*k* side, in the opening hole 103. Note that in the second exemplary embodiment, the drive apparatus 120, the sliding member 100, the advancing/retreating members 70*y*, 70*m* and 70*c* and the like function as an interconnecting unit, an interconnecting mechanism (first interconnecting mechanism). Further, in the second exemplary embodiment, the link member 140, the advancing/retreating member 70*k* and the like function as a second interconnecting mechanism. Furthermore, in the second exemplary embodiment, the second protruding portion 143 functions as an example of interlocking portion.

Figure 22:
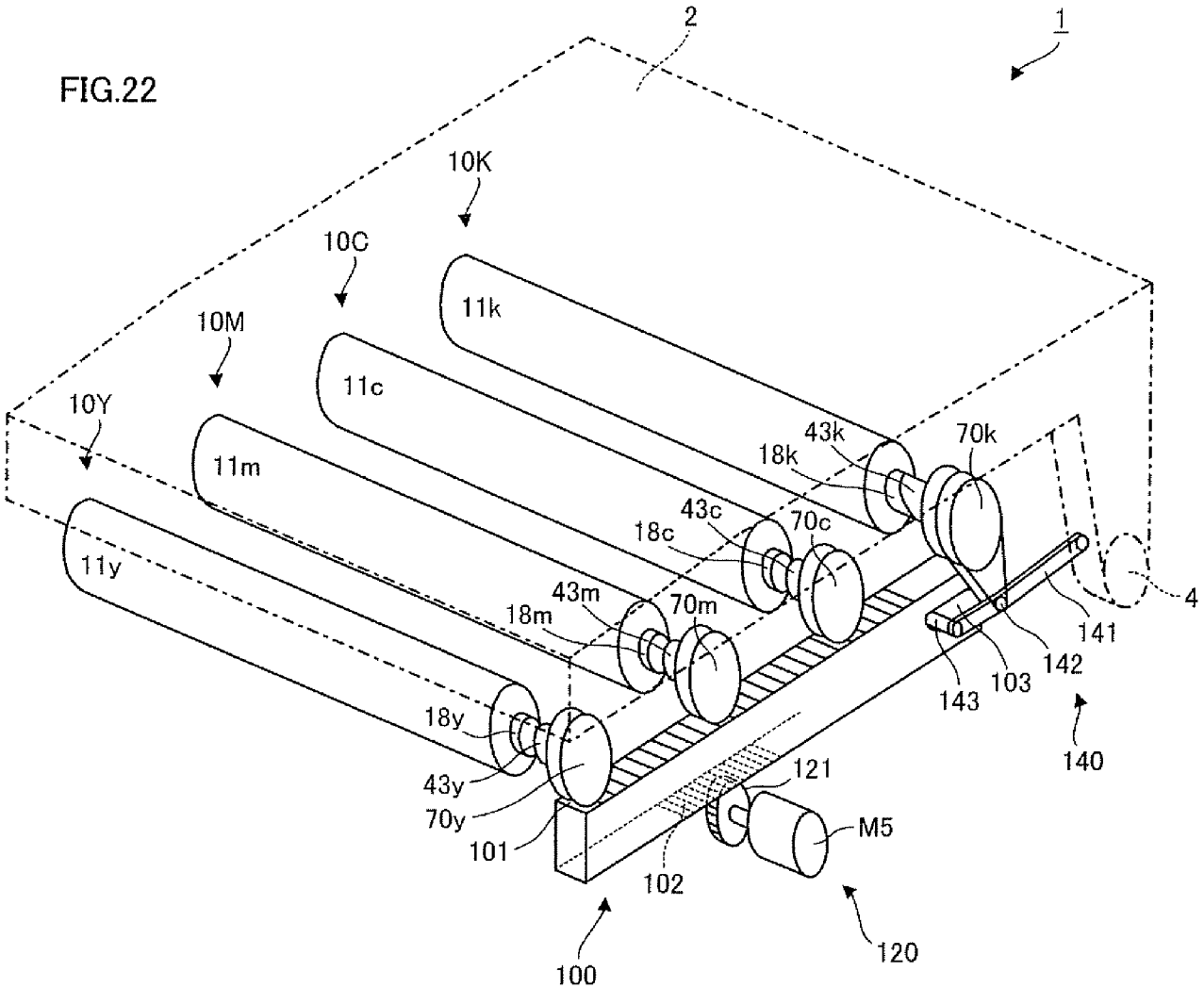
FIG. 22 shows the state after the sliding member is slid by the drive apparatus.

In this state, when the sliding member 100 is slid by the drive apparatus 120 in the direction to the photoconductor drum 11*k* (the arrow A direction in the figure), the state becomes one shown in FIG. 22.

FIG. 22 shows the state after the sliding member 100 is slid by the drive apparatus 120.

When the sliding member 100 is slid, by the first rack gear 101, the respective advancing/retreating members 70*y*, 70*m* and 70*c* are rotated. As a result, the interconnection of the drive side coupling members 43*y*, 43*m* and 43*c*, and the photoconductor side coupling members 18*y*, 18*m* and 18*c* is released. On the other hand, the sliding member 100 and the second protruding portion 143 in the second exemplary embodiment are configured and arranged so as not to bring in contact with each other, when the sliding member 100 is slid in the direction to the photoconductor drum 11*k* by the drive apparatus 120. Therefore, even if the sliding of the sliding member 100 is carried out, the rotation of the advancing/retreating member 70*k* is not carried out, and the interconnection of the drive side coupling member 43*k* and the photoconductor side coupling member 18*k* is maintained.

As a result, only the photoconductor drum 11*k* in the image forming unit 10K gets in a state to be rotated and driven, and the image formation by use of the image forming unit 10K, that is, the image formation in a single color is performed. Meanwhile, when the sliding member 100 is shifted from this state to the original state (the state shown in FIG. 21), the image formation in full colors is performed again. Further, in this state, as shown in FIG. 3B, the paper transportation belt 30 is separated from the photoconductor drums 11*y*, 11*m* and 11*c* in the image forming units 10Y, 10M and 10C.

Figure 23:
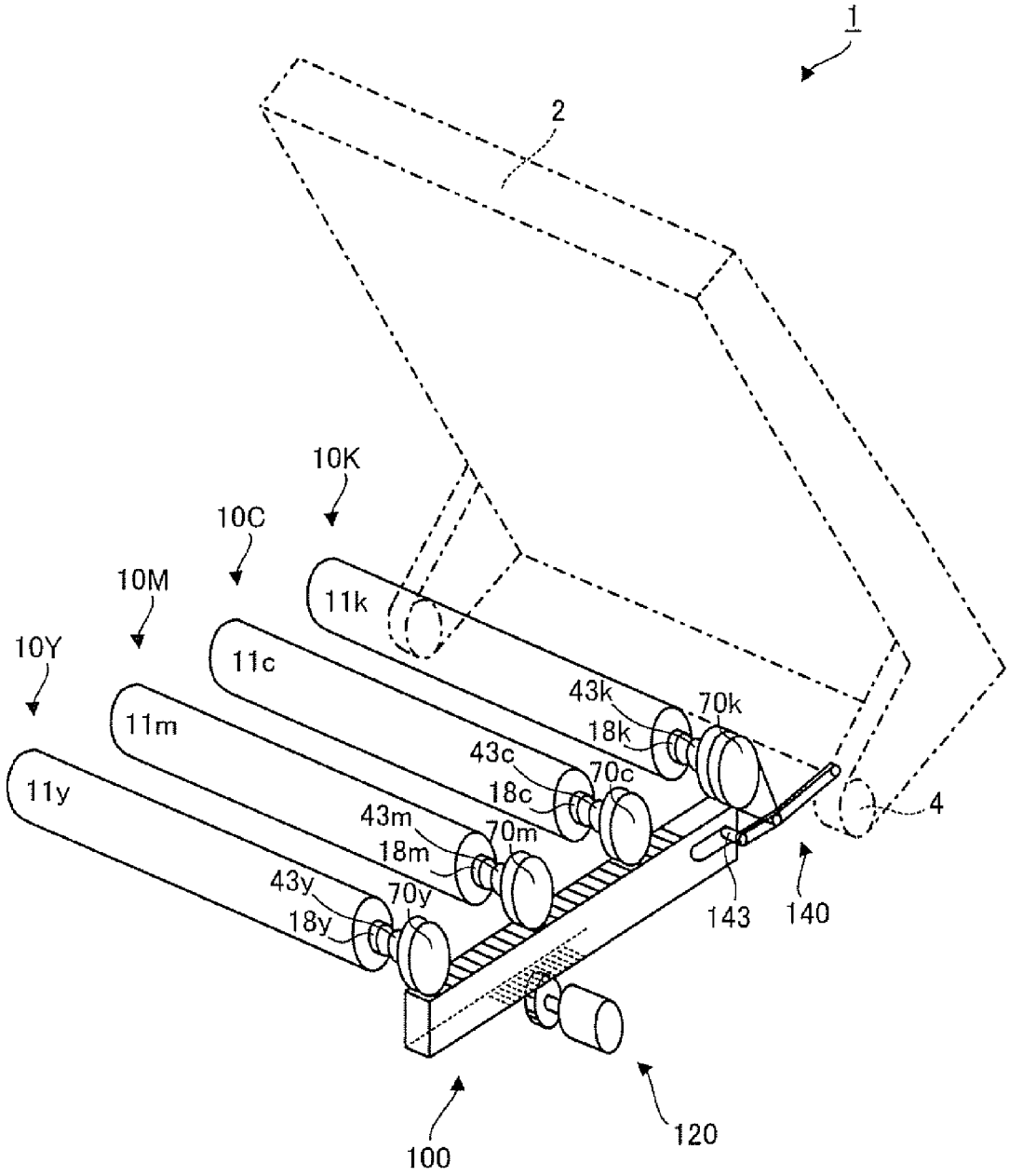
FIG. 23 shows the state after the cover is opened from the state shown in FIG. 21.

Here, FIG. 23 shows the state after the cover 2 is opened from the state shown in FIG. 21. When the cover 2 is opened, the link member 140 moves in the direction leaving from the sliding member 100 by the movement of the cover 2. As a result, the rotation of the advancing/retreating member 70*k* is carried out. Further, when the cover 2 is opened, the sliding member 100 is pushed by the second protruding portion 143, and slides in the direction where the photoconductor drum 11*k* is arranged. As a result, the rotation of the advancing/retreating members 70*y*, 70*m* and 70*c* is carried out. Therefore, also in the second exemplary embodiment, by the opening of the cover 2, the interconnections of all the drive side coupling members 43 and all the photoconductor side coupling members 18 are released.

When the cover 2 is closed from this state, the advancing/retreating member 70*k* is rotated by the link member 140, and the drive side coupling member 43*k* and the photoconductor side coupling member 18*k* are first interconnected. Then, by the drive apparatus 120, the sliding member 100 is slid to the photoconductor drum 11*y* side, the advancing/retreating members 70*y*, 70*m* and 70*c* are rotated, and the drive side coupling members 43*y*, 43*m* and 43*c* and the photoconductor side coupling members 18*y*, 18*m* and 18*c* are interconnected. As a result, a state is realized in which all the drive side coupling members 43 and all the photoconductor side coupling members 18 are interconnected, and the image formation in full colors is performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus having a hitting surface, the image forming apparatus comprising:

a Y-color image forming unit that has a Y-color image carrier holding a yellow toner image, and a Y-color coupling member being arranged corresponding to the Y-color image carrier and transmitting drive force to the Y-color image carrier;

a M-color image forming unit that has a M-color image carrier holding a magenta toner image, and a M-color coupling member being arranged corresponding to the M-color image carrier and transmitting drive force to the M-color image carrier;

a C-color image forming unit that has a C-color image carrier holding a cyan toner image, and a C-color coupling member being arranged corresponding to the C-color image carrier and transmitting drive force to the C-color image carrier;

a K-color image forming unit that has a K-color image carrier holding a black toner image, and a K-color coupling member being arranged corresponding to the K-color image carrier and transmitting drive force to the K-color image carrier;

a Y-color drive coupling member that is connected to the Y-color coupling member and drives the Y-color coupling member;

a M-color drive coupling member that is connected to the M-color coupling member and drives the M-color coupling member;

a C-color drive coupling member that is connected to the C-color coupling member and drives the C-color coupling member;

a K-color drive coupling member that is connected to the K-color coupling member and drives the K-color coupling member;

a first movable plate that is provided with a plurality of rings which are rotated by sliding the first movable plate; and a second movable plate that is provided with a ring which is rotated by sliding the second movable plate, wherein the image forming apparatus is configured such that the Y-color drive coupling member, the M-color drive coupling member and the C-color drive coupling member are interconnected to and released from the Y-color coupling member, the M-color coupling member and the C-color coupling member, respectively, by rotating the plurality of the rings of the first movable plate simultaneously, and the K-color drive coupling member is interconnected to and released from the K-color coupling member by rotating the ring of the second movable plate, wherein the first movable plate with the plurality of rings causes a pin of a shaft to make contact onto the hitting surface of the image forming apparatus, the contact driving at least of one the image forming units.

2. The image forming apparatus according to claim 1, wherein each of the Y-color drive coupling member, the M-color drive coupling member and the C-color drive coupling member is arranged in the inside of each of the plurality of the rings of the first movable plate, and the K-color drive coupling member is arranged in the inside of the ring of the second movable plate.

3. The image forming apparatus according to claim 1, wherein the image forming apparatus is configured such that interconnection of the K-color drive coupling member and the K-color coupling member is maintained when the plurality of the rings of the first movable plate are rotated so that the Y-color drive coupling member, the M-color drive coupling member and the C-color drive coupling member are released from the Y-color coupling member, the M-color coupling member and the C-color coupling member, respectively.

* * * * *